US011149920B2

(12) United States Patent
Bremerich

(10) Patent No.: US 11,149,920 B2
(45) **Date of Patent: *Oct. 19, 2021**

(54) OVAL-CONDENSER ZOOM WITH INDEPENDENT AXIS ADJUSTMENT

(71) Applicant: Matthias Bremerich, Lennestadt (DE)

(72) Inventor: Matthias Bremerich, Lennestadt (DE)

(73) Assignee: ERCO GMBH, Luedenscheid (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/714,952

(22) Filed: Dec. 16, 2019

(65) Prior Publication Data

US 2020/0240612 A1 Jul. 30, 2020

(30) Foreign Application Priority Data

Dec. 21, 2018 (DE) ..... 10 2018 133 386.2

(51) Int. Cl.

| | |
|---|---|
| ***F21V 5/04*** | (2006.01) |
| ***F21V 13/04*** | (2006.01) |
| ***F21W 131/107*** | (2006.01) |
| *F21Y 105/10* | (2016.01) |
| *F21Y 115/10* | (2016.01) |
| *F21Y 101/00* | (2016.01) |

(52) U.S. Cl.

CPC ..... *F21V 5/04* (2013.01); *F21V 13/04* (2013.01); *F21W 2131/107* (2013.01); *F21Y 2101/00* (2013.01); *F21Y 2105/10* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,937,939 | B2 * | 1/2015 | Wirola | G01S 19/254 370/350 |
| 9,494,292 | B2 | 11/2016 | Bremmerich | |
| 10,359,636 | B2 | 7/2019 | Jurik | |
| 2007/0041199 | A1 | 2/2007 | Okada et al. | |

(Continued)

FOREIGN PATENT DOCUMENTS

| | | | |
|---|---|---|---|
| DE | 102009060897 | A | 7/2011 |
| DE | 102010008359 | A | 8/2011 |

(Continued)

*Primary Examiner* — Ashok Patel

(74) *Attorney, Agent, or Firm* — Andrew Wilford

(57) ABSTRACT

The invention relates, inter alia, to a light fixture (10) for illuminating building surfaces (17) or partial building surfaces, comprising a housing (11), at least one light source, in particular an LED (12, 12*a*, 12*b*, 12*c*), and at least one collimating optics, in particular collimating optics (15, 15*a*, 15*b*, 15*c*) for collimating the light emitted by the light source. A particular feature is that at least three lens plates (18, 19) are provided in the light path behind the collimating optics, on each of which lens plates a plurality of lens elements (22*a*, 22*b*, 22*c*, 23*a*, 23*b*, 23*c*, 69*a*, 69*b*, 69*c*, 70*a*, 70*b*, 70*c*) is arranged, in particular grouped, wherein the relative spacings (32, 75) between one of the two outer lens plates, in each case, and the central lens plate, can be changed by means of at least one adjustment device (20), and wherein the light fixture provides different light distributions (37, 38, 39, 50*a*, 50*b*, 50*c*) in different mutual spacing positions of the lens plates.

18 Claims, 15 Drawing Sheets

(56) References Cited

U.S. PATENT DOCUMENTS

| | | | | |
|---|---|---|---|---|
| 2010/0165623 | A1* | 7/2010 | Bremerich | F21V 5/007 362/235 |
| 2010/0309665 | A1 | 12/2010 | Young et al. | |
| 2012/0155102 | A1* | 6/2012 | Melzner | G02B 27/095 362/510 |
| 2015/0211708 | A1* | 7/2015 | Stavely | F21V 14/06 348/164 |
| 2019/0041028 | A1 | 2/2019 | Bremmerich | |
| 2019/0072264 | A1* | 3/2019 | Nagatani | F21V 29/502 |

FOREIGN PATENT DOCUMENTS

| | | | |
|---|---|---|---|
| DE | 102010022477 | A | 12/2011 |
| DE | 102012006999 | A | 10/2013 |
| DE | 102013011877 | A | 1/2015 |
| DE | 202013021308 | A | 6/2015 |
| EP | 2327927 | A | 6/2011 |
| JP | 2012-059575 | * | 3/2012 |

* cited by examiner

OVAL-CONDENSER ZOOM WITH INDEPENDENT AXIS ADJUSTMENT

FIELD OF THE INVENTION

The invention relates to a light fixture for illuminating building surfaces or partial building surfaces.

BACKGROUND OF THE INVENTION

Such a light fixture typically has a housing, at least one light source, in particular an LED and collimating optics for collimating the light emitted by the light source.

Light fixtures of this kind have been developed and produced by the applicant for a considerable time.

Light fixtures of the generic type are described for example in the patent applications DE 10 2008 063 369 A1, DE 10 2010 022 477 A1, DE 10 2009 060 897 A1, DE 10 2010 008 359 A1, EP 2 327 927 A1, DE 10 2012 006 999 A1, DE 10 2013 011 877 A1 and DE 10 2013 021 308 A1, which all originate from the applicant.

It is already known, from the light fixtures of the generic type that are known from the documents, to focus light originating from a light source, in particular an LED, using collimating optics, and to then supply said light to tertiary optics in the form of a lens plate. A lens plate of this kind is described for example in EP 2 204 604 B1.

In order to change the emission characteristics of the light fixture, i.e. the light distribution that can be generated by the light fixture, it is known to use lens plates comprising different lens elements. It is thus possible, for example, to change the emission angle of the light fixture by exchanging a first lens plate for a second lens plate that comprises lens elements having different radii of curvature or different facets.

Finally, a further light fixture of the generic type is known from the post-published German patent application DE 10 2017 122 956 A1 belonging to the applicant.

OBJECT OF THE INVENTION

Proceeding from a light fixture of the generic type, the object of the invention is that of developing a known light fixture in such a way that the light fixture allows for the emission characteristics thereof to be changed in a comfortable manner.

SUMMARY OF THE INVENTION

The invention achieves this object in that at least three lens plates are provided in the light path behind the collimating optics, on which plates a plurality of lens elements is arranged, in particular grouped, in each case, wherein the relative spacings between one of the two outer lens plates, in each case, and the central lens plate can be changed by means of at least one adjustment device, and wherein the light fixture provides different light distributions in positions where the lens plates are at different spacings from one another.

The principle of the invention consists in providing three lens plates. The lens plates are connected one behind the other, in series. The light emitted by the collimating optics first passes through the first lens plate, and then the second lens plate, and finally the third lens plate. Each of the three lens plates comprises a plurality of lens elements. The lens elements are in particular grouped, more particularly arranged so as to be grouped in accordance with a specified grid, or in accordance with a specified structure.

The central one of the two lens plates will be referred to in the following as the central lens plate.

The outer lens plate that is arranged closest, on the LED or LEDs, is referred to as the outer lens plate, and the remaining third lens plate is referred to as the second outer lens plate.

According to the principle of the invention, the light fixture comprises at least one collimating optics. Collimating optics are understood to be a device that can focus the light emitted by the light source. In this case, this can in particular be collimating optics, i.e. a lens element that brings about the collimating. Alternatively, the collimating optics can also be provided by a reflector element.

What is crucial is that parallel or substantially parallel or approximately parallel light is emitted from the light source and the collimating optics, which are also referred to together as the light drive.

Even though, in the course of this patent application, the invention is described with referenced to collimating optics, this is intended to be understood merely by way of example for collimating optics in general.

The light fixture according to the invention further comprises at least one adjustment device. The spacing between two lens plates in each case can be changed by the at least one adjustment device. The light fixture advantageously comprises a first adjustment device that can change the spacing between the first outer lens plate and the central lens plate, and a second adjustment device that can change the spacing between the second outer lens plate and the central lens plate. The two adjustment devices can advantageously be configured and designed such that the spacings from the two outer lens plates to the central lens plate can be changed independently of one another in each case. However, the invention also covers the possibility of the two adjustment device being coupled by a positive control means that ensures that, in the event of a change in the spacing between the first outer lens plate and the central lens plate, the spacing between the second outer lens plate and the central lens plate is automatically also changed.

Finally, it may also be possible for the central lens plate to be displaceable alone, and as a result a relative change in the spacing from the central lens plate to the first outer lens plate, and at the same time to the second outer lens plate, to be achieved.

In a first variant, the at least one adjustment device can displace the first outer lens plate relative to the central lens plate that is rigidly arranged on the housing, or alternatively can displace the central lens plate relative to the first lens plate that is rigidly arranged on the housing.

According to a further variant, all three lens plates are displaceable relative to the housing, and are displaced relative to one another by means of the at least one adjustment device, while changing the spacing thereof.

The principle according to the invention further consists in the light fixture providing different light distributions in when the lens plates are positioned at different spacings from one another. For example, at a first spacing position of the two pairs of lens plates the light fixture can have a first emission characteristic, for example a narrow, oval emission of light, and for example a wider oval light distribution in a second, different spacing position of the pairs of lens plates relative to one another.

According to a particularly advantageous embodiment of the invention, in a first spacing position of a pair of lens plates the light fixture generates a first oval light distribution that extends along a first axial direction, and in a second, changed spacing position of at least one of the pairs of lens plates relative to one another generates a second oval light distribution that extends along a second axial direction, wherein the second axial direction is perpendicular to the first axial direction.

As a result, it is possible to generate absolutely any desired oval light distributions, with respect both to the width of the light distribution and the orientation thereof.

According to a particularly advantageous embodiment of the invention, relative displacement of the first outer lens plate with respect to the central lens plate makes it possible to vary the length of an oval light distribution in a first axial direction, at a constant height, and a relative change in the spacing between the second outer lens plate and the central lens plate makes it possible, in this embodiment, for the length of the oval light distribution to be varied, at a constant height, in the direction of a second direction that is perpendicular to the first direction.

A light fixture for illuminating building surfaces is considered to be any light fixture that is used as a floor, wall or ceiling light fixture of a building, optionally as a radiator or recessed light fixture, for illuminating a building surface or a building partial surface. Equally, this covers light fixtures that can illuminate surfaces of an outside region of a building, i.e. for example parking-lot surfaces, green spaces or footpaths. Building surfaces to be illuminated are also to be understood as paintings or art installations that are to be illuminated.

The light fixture can be designed as a radiator for example, and be arranged for example in the ceiling in a building space, or in the ground, and also in an outside space, such that it can be changed in position and fixed. However, it can also be designed as a downlight for example and illuminate floor regions or wall regions of the building space.

The light fixture comprises a housing in which at least the light source is accommodated. In particular the light fixture optionally also comprises self-evident components, such as a socket for the light source, e.g. a circuit board in the case of a light source designed as an LED, and electronic control elements or other electronic components. The light fixture can also comprise a voltage supply. The light fixture can be associated with an integrated or external operating device that is arranged in a separate housing or in the same housing.

Preferably one or more LEDs are provided as the light source. Alternatively, other light sources such as lasers are also possible. Preferably punctiform or almost punctiform light sources are used.

What are known as COB-LEDs (i.e. chip on board LEDs) are also possible as the light source. Together with a reflector or together with a collimator, for example, said LEDs can provide collimating optics within the meaning of the invention.

The light source forms a unit together with the collimating optics. The collimating optics are used for collimating the light emitted by the light source, in particular the LED. When using an LED as the light source, the collimating optics can be conventional collimating optics, as is disclosed in the IP rights of the applicant described at the outset, the content of which is hereby included in the disclosure of this patent application.

Within the context of this patent application, the light source together with the collimating optics, in particular the collimating optics, are also referred to as the light drive. The light drive is used in particular for casting parallel, or substantially parallel, light onto the input side of a first lens plate. The three lens plates are formed so as to be transparent or translucent, and consist for example of a see-through plastics material or of glass. The lens plates are preferably each provided from plastics material, e.g. PMMA or acrylic glass, or a comparative plastics material, and can in particular be formed by an injection molded part.

The two outer lens plates can be identical or substantially identical. Even if, in this embodiment, the two outer lens plates are identical in shape, they can still be oriented or positioned differently. In a variant of the invention, all three lens plates are different.

The light emitted by the collimating optics enters the entry surface of the first lens plate, and emerges through the exit side of the first lens plate. From there, said light is directed to the entry side of the second, central, lens plate, and emerges through the exit surface of the second lens plate. From there it strikes the entry side of the second outer lens plate, and subsequently emerges again through the exit surface of the second outer lens plate.

In the light path behind the second outer lens plate, the light fixture can also comprise a termination glass. However, the invention relates in particular to light fixtures in which no further optical elements are arranged in the light path behind the second outer lens plate. Of course, the invention also relates to luminaries in which a diffusor film or comparable elements are also arranged in the light path, behind the second outer lens plate.

According to the invention, at least one adjustment device is provided. The spacing between the two pairs of lens plates can be changed in each case by means of the adjustment device or by means of the two adjustment devices. The adjustment devices can be motorized or can change the spacing between the two pairs of lens plates as a result of manual actuation. The adjustment path can be for example a few millimeters. The pairs of lens plates can in each case be displaced at least between a first spacing position and a second spacing position. In a first spacing position of the first pair of the two pairs of lens plates, the light fixture generates a first light distribution, and in a second, different spacing position of the first pair of the two lens plates, when the spacing position of the second pair of the two pairs of lens plates is unchanged or changed, the light fixture generates a second distribution that is different from the first.

In the same way, in a different spacing position of the second pair of the two pairs of lens plates, when the spacing position of the first pair of the two pairs of lens plates is changed or unchanged, the light fixture generates a third light distribution.

The different light distributions described can for example comprise different oval light distributions of the light fixture, for example a first axially short oval light distribution in a first axial direction, furthermore a second elongate oval light distribution in the same axial direction, as a third light distribution, a first short oval light distribution in a second axial direction that is perpendicular to the first axial direction, and as a fourth light distribution, a second axially elongate oval light distribution in the second axial direction.

In a variant of the invention, the spacing between two lens plates in each case can be changed continuously, and more preferably in a substantially stepless manner. In an alternative embodiment of the invention, the spacing between two lens plates in each case can be changed in discrete steps, i.e. for example in a stepped manner.

Numerous lens elements are arranged on each of the three lens plates. The lens elements, in particular the lens elements of the central lens plate, can be provided for example by spherically or aspherically curved facets.

In a variant of the invention, one lens element, in each case, on the first outer lens plate is associated with a plurality of lens elements on the central lens plate. In this variant, the light falling from the collimating optics onto the lens element of the first outer lens plate is directed solely to a plurality of specific opposing lens elements on the central lens plate. According to a variant of the invention, this clear association of the lens elements on the different lens plates is also retained for different spacing positions.

Similarly, it is advantageous for the light falling on the central lens plate, from a lens element, to always strike only a specified lens element of the second outer lens plate.

In an advantageous embodiment of the invention, this association, too, can be maintained for different spacing positions of the lens plates.

Owing to the fact that the collimating optics shines parallel or substantially parallel light onto the first outer lens plate, the individual beams are comparable.

Every, or almost every, lens element on the first outer lens plate is fixedly associated, in an opposing manner, with lens elements on the central lens plate. Corresponding pairs of mutually opposing lens elements each exhibit the same optical behavior at different spacing positions of the lens plates relative to one another.

The fixed association of one lens element, in each case, of the first outer lens plate with a plurality of lens elements of the central lens plate is ensured in that, in an embodiment of the invention, the rotational position of said two lens plates relative to one another is not changed during the spacing change. A positioning device can ensure this.

In another embodiment of the invention, however, during a relative spacing change of a pair of two lens plates, the rotational position of said to lens plates can also change.

According to the invention, the lens elements can each be arranged on one side, or can each be arranged on both sides, of at least one of the lens plates.

If the lens elements are arranged only on one side of the lens plate, said elements can be arranged so as to face one another or so as to face away from one another.

The invention further relates to the case where the lens elements of a lens plate are all designed identically or in a manner similar to one another. However, the invention also relates to the case where the lens plates carry different lens elements or a plurality of groups of different lens elements, wherein the lens elements of one group are identical.

The lens elements of one lens plate can for example have an identical radius, such that all the lens elements of one lens plate have an identical focal length.

The lens elements of one of the two other lens plates can have the same or a different radius. In a variant of the invention, the focal length of the lens elements of the first outer lens plate is larger or smaller than the focal length of the lens elements of the central lens plate, or larger or smaller than the focal length of the lens elements of the second outer lens plate.

The individual lens elements, in particular on the central lens plate, can for example be provided by spherical or aspherical bulges, for example also by rotational paraboloids. The individual lens elements can be described approximately by a spherical shape or by a radius.

According to an advantageous embodiment of the invention, the at least one adjustment device comprises at least one motorized, in particular electromotive, drive. An adjustment device is for example equipped with an electric motor that can ensure direct displacement of at least one lens plate relative to at least one other lens plate. The drive can cooperate with a controller that can receive control commands. For this purpose it may be possible, for example, for an actuation device to be provided direction on the light fixture, in particular in the housing of the light fixture, or on a housing of the operating device, or so as to be directly associated with the light fixture, which actuation device allows a user to directly or indirectly input control commands for changing the light emission characteristics of the light fixture. Alternatively, the drive can also be operated by means of a central light fixture control system, e.g. from a command center arranged so as to be remote or at a distance from the light fixture, e.g. from a light control center.

According to a further advantageous embodiment of the invention, the at least one adjustment device comprises at least one manually actuatable adjustment element. In this case for example manual actuation, e.g. by means of a rotary switch, a toggle, a rotatable adjusting ring, or another actuator, can provide for a spacing change between two lens plates in each case.

According to a further advantageous embodiment of the invention, the adjustment device is associated with a positioning device that ensures that the relative rotational position between at least two, preferably all three, lens plates is maintained when a spacing change between the two lens plates is carried out. In this case, the relative rotational position of at least one lens plate relative to at least one other lens plate is maintained during the spacing change. This can be ensured for example by a rotation prevention means that comprises, for example, guide rods or corresponding receptacles or the like.

It is also possible for axial bearings to ensure the desired axial movement of the lens plates relative to one another, without a rotational movement being performed.

According to a further advantageous embodiment of the invention, the different light distributions have different beam angles of the light fixture in different axial directions.

According to a further advantageous embodiment of the invention, in a first spacing position of a first pair of lens plates the different light distributions of the light fixture comprise a first oval light distribution that is extended along a first axial direction.

It may furthermore be possible that, in a different spacing position of said pair of lens elements and/or in another spacing position of the other pair of lens elements, the light fixture may generate a second light distribution that is different from the first light distribution and in which an oval light distribution is also achieved. In this case, the second oval light distribution can be formed so as to be elongate along a second emission direction, wherein the second axial direction is perpendicular to the first axial direction.

In addition, numerous further light distributions can be achieved, bringing about a continuous fluid transition between the described light distributions. In this case, circular or square, or approximately circular or approximately square, light distributions can also be generated.

A change in the light distribution according to the invention can for example comprise a change in the beam angle from a first oval, axially short characteristic to a second oval, axially extended characteristic.

An oval light emission characteristic within the meaning of the present patent application in particular comprises a light distribution having a contour that is designed so as to be extended further in a first direction than in a second direction that is perpendicular to the first direction.

For the sake of formality, it is noted that the beam angle or the angle specification within the meaning of the invention denotes in particular the angle that is referred to, by a person skilled in the art, as the opening angle and represents what is known as the "full width half max" value. This is therefore the value of the light beam angle at which the light intensity has dropped approximately to half the maximum light intensity.

In this respect, a contour of a light distribution is the course of said "full width half max" value that can be identified on the building surface to which the emission is directed and/or that is measurable.

According to an advantageous embodiment of the invention, the respective spacing between the lens plates of one pair of lens plate can be changed continuously. This can be ensured by a steplessly operating adjustment device. A continuous change in the spacing between the two lens plates can achieve a continuous change in the emission characteristics of the light fixture, in particular a continuous change in the beam angle or a continuous change in the ovality of the emission characteristics or of the oval light distribution.

According to a further advantageous embodiment of the invention, at least one of the three lens plates is fixedly arranged relative to the housing, and the two other lens plates can be displaced relative to the central lens plate and/or relative to the housing by means of at least one adjustment device.

This can ensure a particularly precise adjustment of the lens plates relative to one another.

According to a further advantageous embodiment of the invention, the lens elements on at least one of the three lens plates comprise facets. The facets are in particular curved. Advantageously, all or almost all the lens elements are designed as facets. More advantageously, all or almost all the facets are designed so as to be identical.

The facets can be spherically or aspherically curved. They can in particular also approximate a sphere. Furthermore, the facets can be provided by a rotational paraboloid, and for example have a parabolic or substantially parabolic cross section.

According to a further advantageous embodiment of the invention, a lens element can be assigned a focal length. In this case, it is advantageously possible for every or almost every lens element to be assigned the same or approximately the same focal length.

More advantageously, the adjustment path along which a change in the mutual spacing between two lens plates, in each case, can be carried out is approximately in the order of magnitude of two focal lengths. This means that two lens plates, in each case, can be displaced relative to one another between a first spacing position, in which they are in contact with one another, and a second spacing position, in which they are spaced apart from one another by approximately two focal lengths.

According to a further advantageous embodiment of the invention, in each case at least one lens element of one lens plate is associated with at least one lens element of the other lens plate. The association can in particular be fixed. This means that the association is maintained, even during a change in the spacing between two lens plates. In this case, it may furthermore advantageously be possible for the light falling from the collimating optics onto a specified lens element of the first outer lens plate to be deflected exclusively toward a plurality of specified opposing lens elements of the central lens plate. According to an embodiment of the invention, it may furthermore advantageously be possible for the light emitted by a lens element of the central lens plate to always be cast toward a specific lens element of the second outer lens plate.

More advantageously, this fixed association is unchanging along the entire adjustment path.

According to a further advantageous embodiment of the invention, the association is made such that light components emerging from the collimating optics strike a lens element of the first outer lens plate, and are directed therefrom only toward specific lens elements of the central lens plate.

According to a further advantageous embodiment of the invention, the association of the lens elements of the first outer lens element with the lens elements of the central lens plate is maintained in the event of a change of the spacing between the lens plates.

According to a further advantageous embodiment of the invention, the lens elements on a first outer lens plate and on a second outer lens plate comprise lenticular lenses or lenticular facets. In this case, these are axially extended lenticular facets that are curved along a first plane and are not curved, or are at most weakly or slightly curved, along a second plane transverse to said first plane.

In a particularly advantageous embodiment of the invention, the light fixture comprises three lens plates; a first outer lens plate, a central lens plate, and a second outer lens plate.

Advantageously, lenticular lenses are arranged on the two outer lens plates. The central lens plate advantageously comprises lenticular facets.

The lenticular lenses of the first outer lens plate are extended in a first direction, and the lenticular lenses of the second outer lens plate are extended along a second direction, wherein the second direction is perpendicular to the first direction.

As a result, oval light distributions of different widths can be generated in two different, mutually perpendicular, axial directions. Circular or approximately circular, or square or approximately square, or rectangular or approximately rectangular light distributions or light field contours can be generated by superimposition of two oval distributions.

In a further advantageous embodiment of the invention, the three lens plates are fixedly arranged with respect to one another, in a relative rotational position, such that the rotational position of said lens plates does not change in the event of an axial displacement of the lens plates.

In an alternative embodiment of the invention, it is possible to change the rotational position of at least one of the three lens plates relative to the at least one other of the three lens plates.

The object of the invention is also that of specifying a method that can achieve a change in the emission characteristics of a light fixture in a comfortable manner.

In this case, the principle consists in providing a plurality of lens elements directly on the collimating optics, in particular on the exit side or light exit side thereof, and arranging two lens plates in the light path behind the collimating optics, instead of three lens plates arranged in the light path behind the collimating optics.

In this case, either the collimating optics can be displaced relative to the fixed central lens plate, or the central lens plate can be displaced relative to the collimating optics. Similarly, the second outer lens plate can be displaced relative to the central lens plate, or the central lens plate can also be displaced relative to the second outer lens plate, by means of an adjustment device, for the purpose of changing the emission characteristics of the light fixture.

According to this embodiment, it is advantageous for lenticular lenses to be arranged on the light exit side of the collimating optics.

Furthermore, in order to explain this invention and in order to avoid repetitions, reference is made to that stated above relating to the light fixtures of this invention, the explanations and advantageous embodiments, in terms of features, of which can be used, within the context of the invention, in a similar manner in the invention as claimed.

BRIEF DESCRIPTION OF THE DRAWING

Further advantages of the inventions can be found in the dependent claims (not cited), and with reference to the following description of the numerous embodiments shown in the figures.

In the figures.

SPECIFIC DESCRIPTION OF THE INVENTION

Figure 1A:
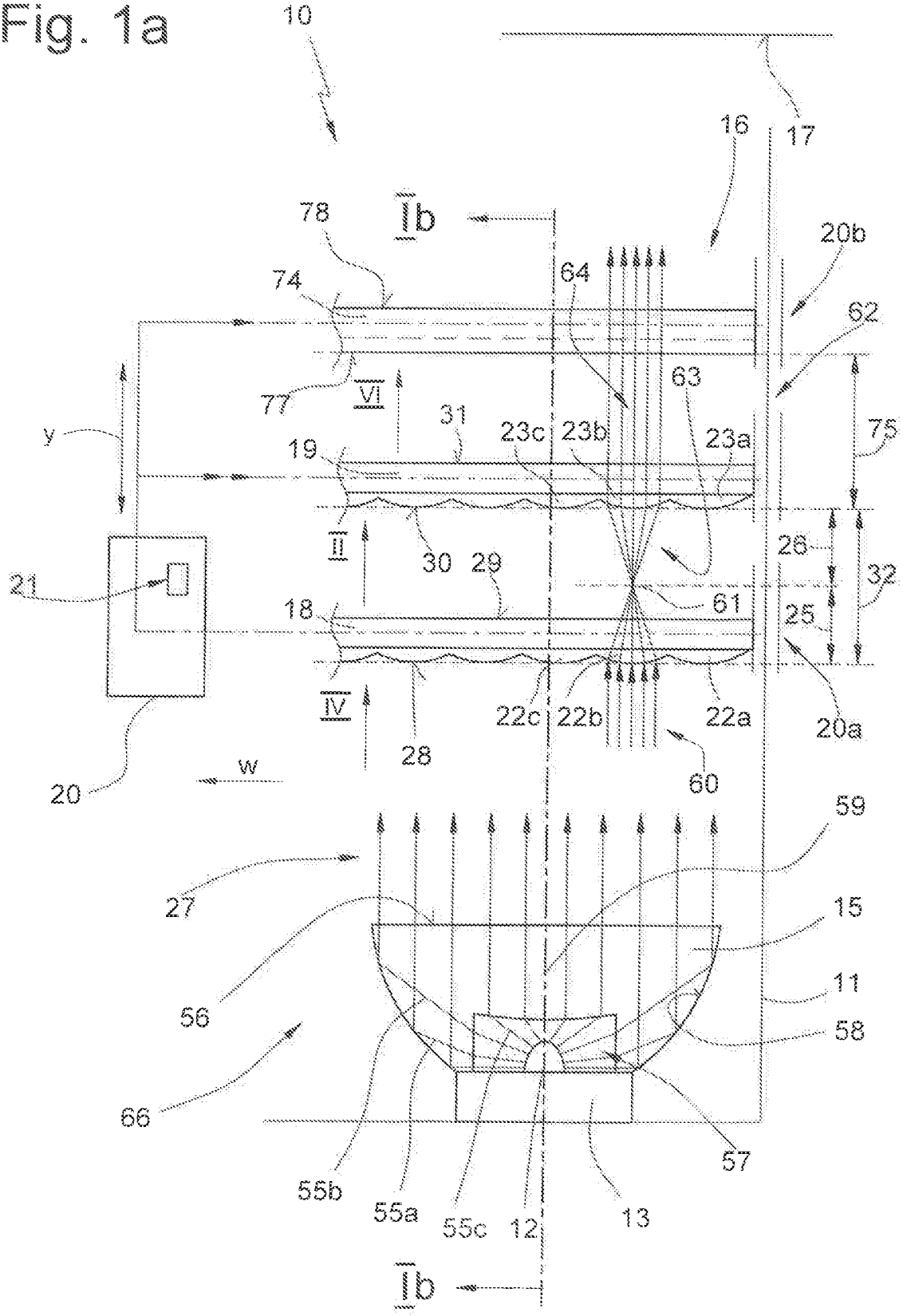
FIG. 1*a* is a partially cut away block diagram-like view of a first embodiment of a light fixture according to the invention having a light drive comprising an LED and a collimator, and three lens plates that can be adjusted relative to one another by means of two adjustment devices.

Embodiments of the invention are described, by way of examples, in the following description of the figures, with reference to the drawings. In this case, for the sake of clarity, also where different embodiments are concerned, identical or comparable parts or elements or regions are demoted by the same reference signs, sometimes lower-case letters being added.

Within the context of the invention, features that are described only in relation to one embodiment can also be provided in all other embodiments of the invention. Amended embodiments of this kind are also covered by the invention, even if they are not shown in the drawings.

All the disclosed features are per se essential to the invention. The disclosure both of the associated priority documents (copy of the prior application) and of the cited documents and the described devices of the prior art are hereby incorporated, in their entirety, in the disclosure of the application, also for the purpose of incorporating individual features or a plurality of features of said documents in one claim or in a plurality of claims of the present application.

An embodiment of the light fixture according to the invention will first be explained with reference to FIGS. 1*a* and 1*b:*

Said figures are merely highly schematic views of a light fixture 10 that comprises a housing 11. Inside the housing 11 (shown merely broken and by way of indication), an LED 12 is arranged on a circuit board 13 (indicated schematically). The LED is supplied with the required operating voltage via voltage supply lines (not shown here, but denoted for example 14 in FIG. 10). For the sake of simplicity, further electronic components that are provided for generating the operating voltage required for the LED are not shown.

The LED emits light in a manner distributed over a large solid angular range of for example 180°. The LED 12 is located in a cavity 57 of collimating optics 15 that provides collimating optics. The collimating optics 57 comprises total internal reflection surfaces 58 and a cover portion 59. Overall the collimating optics 15, together with the LED 12, constitutes a light drive that is used for generating a substantially parallel light beam 27.

Furthermore, a first outer lens plate 18, a central lens plate 19 and a second outer lens plate 74 are arranged inside the light fixture housing 11. The parallel bundle of light rays 27 strikes the light entry surface 28 of the first outer lens plate 18 as a parallel partial bundle of light rays 60, passes through said surface, and emerges in the region of the light exit surface 29 of the first outer lens plate 18. From there, the light strikes the light entry surface 30 of the central lens plate 19 and emerges through the light exit surface 31 of the central lens plate 19.

From the central lens plate 19, the light strikes the entry side of a third lens plate, specifically the second outer lens plate 74, and emerges through the light exit surface thereof.

In the embodiments of the light fixture according to the invention that are shown in the drawings, no further optical element is arranged in the light path behind the second outer lens plate 74. From there, the light can directly strike the building surface 17 to be illuminated, which surface is indicated only schematically and not to scale in FIG. 1*a*.

Thus, in this embodiment, no termination glass or the like is provided in the region of the light exit opening 16 of the light fixture 10. In this case, the second outer lens plate 74 can function as a type of termination glass of the light fixture 16.

The spacing between the first outer lens plate 18 and the central lens plate 19 is denoted 32 in the figures. In this case for example the spacing between the light entry surface 29 of the first outer lens plate 18 and the light entry surface 30 of the central lens plate 19 is measured. Other reference points are also covered by the invention.

The spacing between the central lens plate 19 and the second outer lens plate 74 is denoted 75 in the figures.

According to the invention, the spacing 32 between the two lens plates 18, 19 can be changed by means of a first adjustment device 20*a*.

Furthermore, according to the invention, the spacing 75 between the central lens plate 19 and the second outer lens plate 74 can be changed by means of a second adjustment device 20*b*.

The two adjustment devices 20*a*, 20*b* can comprise one motorized drive 21 each or a common motorized drive, which is merely indicated in FIG. 1*a*. The motorized drive 21 can for example receive control commands from a light fixture controller via a signal or control line (not shown).

However, the adjustment devices 20*a*, 20*b* can also each comprise a manually operable actuation element, and a motorized drive can be omitted entirely.

A manually actuatable element of this kind for changing the spacing is disclosed for example in FIGS. 10 and 13 of the German patent application DE 10 2017 122 956 A1 by the applicant, and therefore, in order to avoid repetitions, reference is made to the descriptions therein. In order to be able to vary the spacings 32, 75 in a mutually independent manner, it is also possible for two manually actuatable elements of this kind, adapted accordingly, to be provided for the two adjustment devices 20*a*, 20*b*.

According to the invention, the design of the adjustment device is not important. The essential aspect of the invention is that the three lens plates 18, 19, 74 should be able to be displaced relative to one another in the axial direction Y, while changing their mutual spacings 32, 75.

Figure 4:
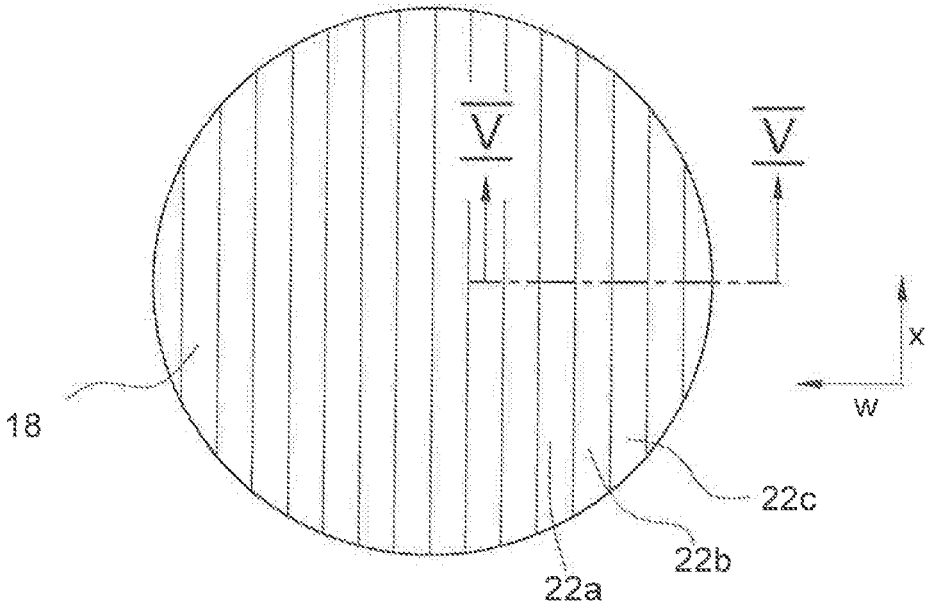
FIG. 4 is a view according to FIG. 2, approximately along the elevation arrow IV in FIG. 1*a*, of an embodiment of a first outer lens plate according to the invention, showing lenticular lenses.

As is clear from the embodiment of FIG. 1*a* in connection with FIG. 4, a plurality of lens elements that are extended in direction X, referred to as lenticular lenses, in the form of extended lens elements 22*a*, 22*b*, 22*c* are arranged along the light entry surface 28 of the first outer lens plate 18. The lens elements 22*a*, 22*b*, 22*c* in the form of extended lens elements are arranged so as to be directly adjacent to one another. The invention also relates to the case in which small spacings are provided between the lens elements 22*a*, 22*b*, 22*c*.

A plurality of lens elements 23*a*, 23*b*, 23*c* is also arranged on the central lens plate 19. The central lens plate 19 can comprise individual facets 23*a*, 23*b*, 23*c* that each have a spherical cross section and are consequently formed for example by a spherically curved body, e.g. a spherical section, or approximate a body of this kind.

The facets can also be formed by a body having a different curvature, e.g. an aspherical curvature. In particular, the individual facets can each have a parabolic cross section, and consequently be formed as a rotational paraboloid.

Figure 2:
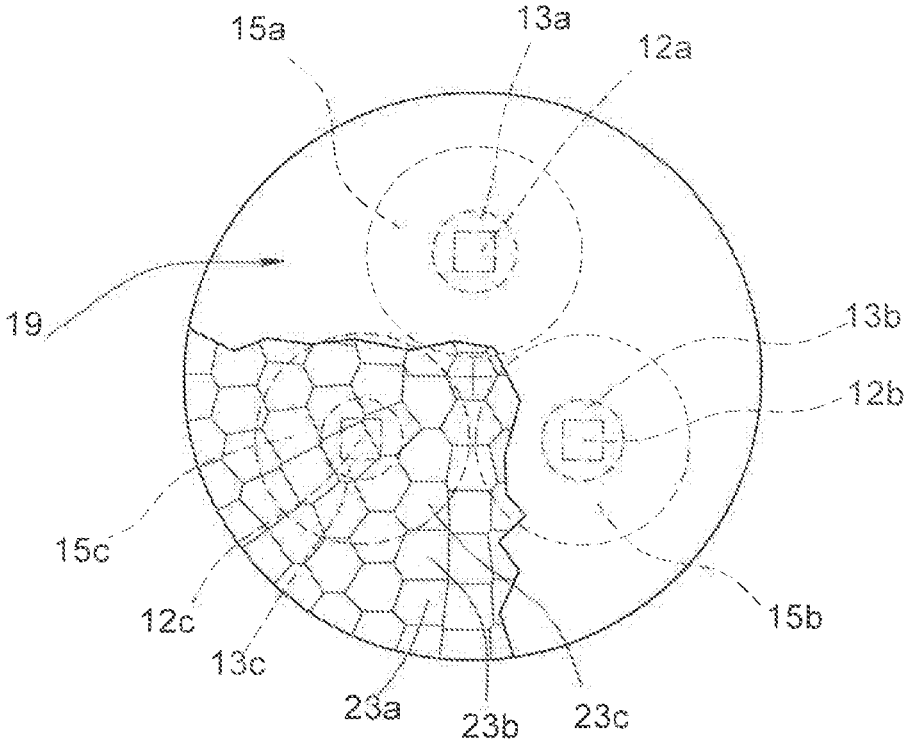
FIG. 2 is a truncated schematic view from below, approximately along the elevation arrow II in FIG. 1*a*, of the central lens plate, the relative positions of the light drives being indicated.
Figure 3:
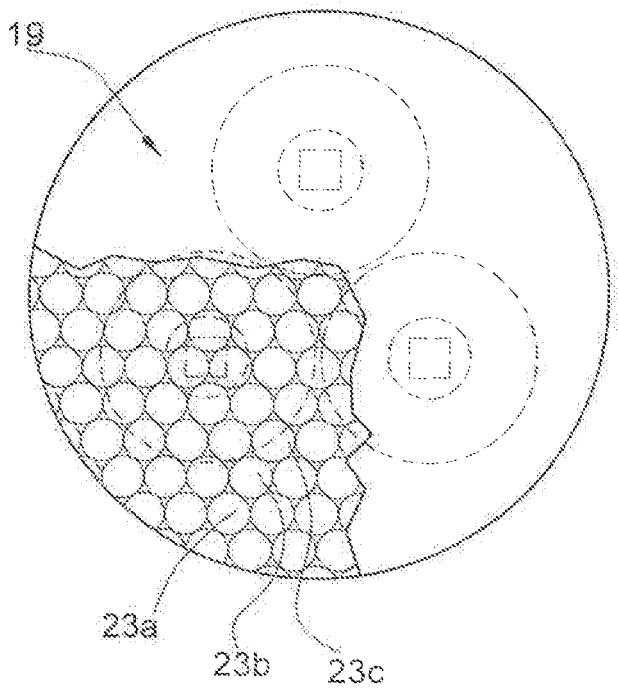
FIG. 3 shows a further embodiment of a central lens plate according to the invention, in a view according to FIG. 2.

FIGS. 2 and 3 show a corresponding arrangement of said facets 23*a*, 23*b*, etc.

As is clear from the drawing in FIG. 1*a*, each of the lenticular lens elements 22*a*, 22*b*, 22*c* is assigned a focal length 25. This results in an incident beam 60 of parallel light, which for example according to FIG. 1*a* strikes the lenticular lens element 22*b*, is focused in a focal point line 61 that extends perpendicularly to the paper plane of FIG. 1*a*. The individual light rays intersect here.

Further along the path of the light, the light diverges from the focal point line 61 and strikes the lens element 23*b* on the central lens plate 19. Since the facet 23*b*—in the paper plane of FIG. 1*a*—is curved toward the lens 22*b* of the first outer lens plate 18 in an identical manner, said facet should be assigned an identical focal length 26. The focal length 25 of the lens 22*b* of the first outer lens plate 18 and the focal length 26 of the facet 23*b* of the central lens plate 19 are therefore identical.

FIG. 1*a* shows the two lens plates 18, 19 spaced apart at a spacing 32 that is twice or approximately twice the focal length 25 (i.e. at the same time also twice the focal length 26).

In this respect, the partial bundle of light rays 63 emanating from the focal point line 61 and striking the facet 23*b* is collimated again by the facet 23*b* and transformed into a parallel bundle of light ray 64.

Said parallel bundle of light rays 64 then strikes the third lens plate 74, i.e. the second outer lens plate 74, and, at least in the perspective of the paper plane in FIG. 1*a*, is not influenced with respect to the optical path thereof.

It should be noted in addition that the block diagram-like schematic view in FIG. 1*a* indicates a linear guide 62. According thereto, the first outer lens plate 18 is arranged so as to be movable relative to the housing 11, and the central lens plate 19 is arranged so as to be fixed relative to the housing 11. The first outer lens plate 18 can be displaced along the linear guide 26, in the axial direction Y, by means of the adjustment device 20*a*.

Similarly, the second outer lens plate 74 can also be displaced in the axial direction Y, relative to the fixedly retained central lens plate 19, by means of the second adjustment device 20*b*.

It is clear from FIGS. 2 and 3 that a plurality of lens elements 23*a*, 23*b*, 23*c* is arranged on the central lens plate 19, wherein only some of said facets are provided with reference signs.

In combination with FIG. 1*a*, it is clear that, in this embodiment, the lens elements 22*a*, 22*b*, 22*c*, 23*a*, 23*b*, 23*c* on the first outer lens plate 18 and on the central lens plate 19 are arranged on the light entry side 28, 30 in each case, and the light exit surface 29, 31 of the relevant lens plate 18, 19 is kept planar.

In other embodiments, the relevant lens plates 18,19 can also be oriented differently, for example such that the lens elements are arranged on the light exit side 29, 31 and the respective light entry side 28, 30 is kept free of lens elements. According to the invention, the orientation of the lens elements 22*a*, 22*b*, 22*c*, 23*a*, 23*b*, 23*c* with respect to the light source 12 is not important.

It is clear from FIGS. 2 and 3 that the light fixture 10 can comprise a substantially circular light exit opening 16, and accordingly the three lens plates 18, 19, 74 are also circular disc-shaped. However, the invention is not limited to this geometry. Light fixtures that comprise a square or rectangular light exit opening or a light exit opening having another e.g. polygonal curved path, are also covered by the invention.

It is furthermore clear from FIGS. 2 and 3 that, in the embodiment of FIG. 1*a* to 3, each light fixture comprises three collimating optics 15*a*, 15*b*, 15*c*. However, the number of collimating optics 15, 15*a*, 15*b*, 15*c* is arbitrary. It in particular also depends on the number and the design of the LEDs.

Furthermore, it is clear from FIGS. 2 and 3 that each collimating optics 15 (and thus also each LED 12) is associated with a plurality of individual lens elements 23*a*, 23*b*, 23*c*. Thus, for example, the view in FIG. 2 shows that the collimating optics 15*c* is associated with more than twenty individual facets 23*a*, 23*b*, 23*c*.

Since each collimating optics 15 or each LED 12 is in each case associated with a plurality of lens elements 23*a*, 23*b*, 23*c*, the structure of the light source 12 can be dissolved, and can no longer be identified by a viewer located in the space. Similarly, the structures of the LED or of the collimating optics are no longer identifiable in the light distribution on the building wall 17. The light distribution on the building wall is homogenous.

According to an advantageous embodiment of the invention, the first outer lens plate 18 and the second outer lens plate 74 are each designed so as to be identical, but are arranged so as to be rotated by 90° relative to one another.

These different rotational positions are clear from a comparison of FIGS. 1*a* and 1*b*, and FIGS. 4 and 6.

The respective lenticular lenses 22*a*, 22*b*, 22*c* and 76*a*, 76*b*, 76 extend in mutually perpendicular directions X and Y.

As shown in FIG. 1*a*, the two lens plates 18, 19 are positioned so as to be axially spaced from one another, such that each lenticular lens element 22*a*, 22*b*, 22*c* of the first outer lens plate 18 is fixedly associated with a plurality of specific lens elements 23*a*, 23*b*, 23*c* of the central lens plate 19. It is thus clear from FIG. 1*a* that the lens element 22*b* of the first outer lens plate 18 is always fixedly associated with the lens element 23*b* of the central lens plate 19. This fixed association is advantageously also maintained while and/or after a change in spacing between the two lens plates 18, 19 is being/has been performed.

In addition, each lens element 23*a*, 23*b*, 23*c* of the central lens plate 19 is always fixedly associated with a lens element 76*a*, 76*b*, 76*c* of the second outer lens plate 74.

Figure 8A:
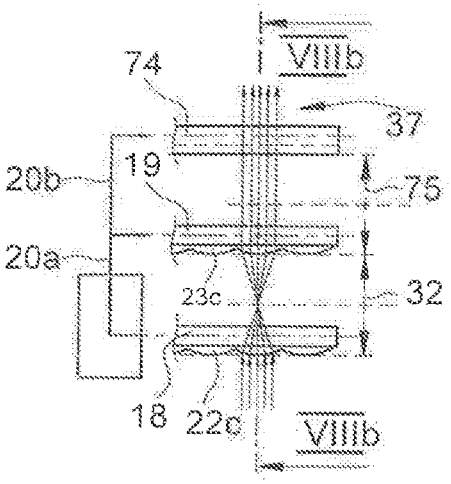
FIG. 8*a* is a partially cut away, downscaled schematic view of a detail of the light fixture of FIG. 1, indicating the adjustment device and the three lens plates in a first maximum spacing position.
Figure 8B:
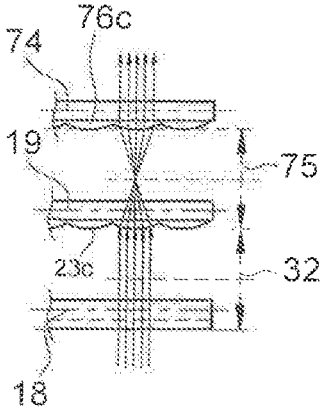
FIG. 8*b* is the detail of the light fixture of FIG. 8*a* in an arrangement rotated by 90°, approximately along the cutting line VIIIb-VIIIb in FIG. 8*a*.
Figure 9A:
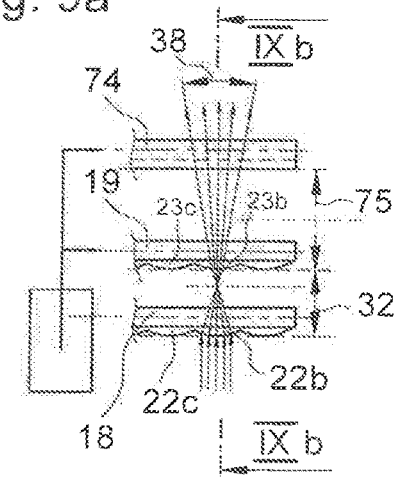
FIG. 9*a* shows the schematic arrangement of FIG. 8*a* having a changed mutually spacing position between the first outer lens plate and the central lens plate, wherein the spacing between the central lens plate and the second outer lens plate is unchanged.
Figure 9B:
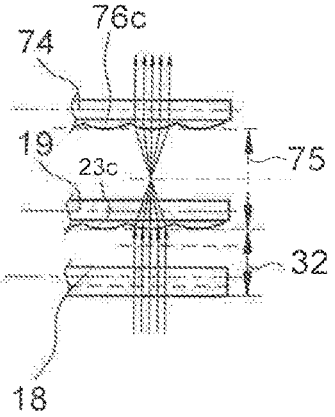
FIG. 9*b* is a view according to FIG. 8*b* of the light fixture according to FIG. 9*a*.
Figure 9C:
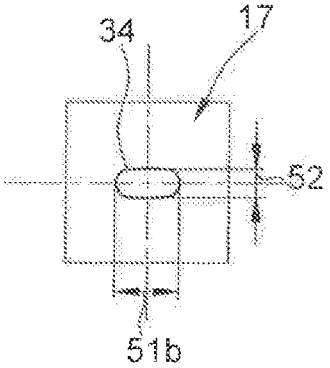
FIG. 9*c* is a view according to FIG. 8*c* of the light distribution in the case of a lens plate spacing according to FIGS. 9*a* and 9*b*.
Figure 10A:
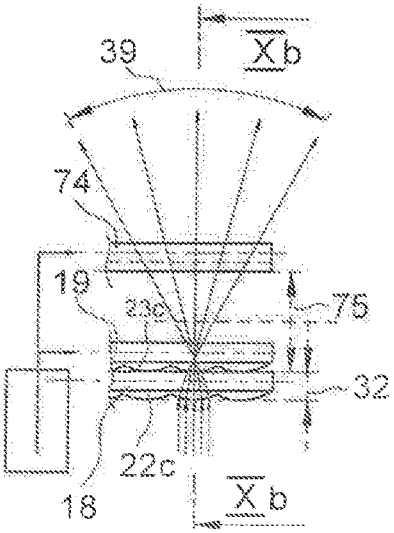
FIG. 10*a* is a schematic view of the light fixture of FIG. 8*a* comprising a first outer lens plate and central lens plate that are as close together as possible, while the spacing between the central lens plate and the second outer lens plate is unchanged.
Figure 10B:
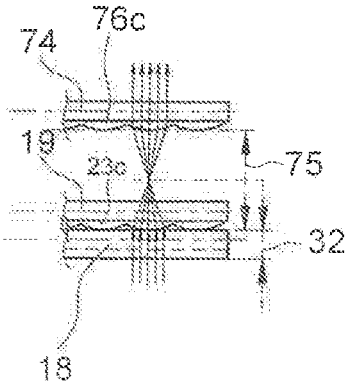
FIG. 10*b* shows the light fixture of FIG. 10*a* rotated about 90°, approximately along the cutting line Xb-Xb in FIG. 10*a*.

As is clear from FIGS. 8*a*, 8*b* to 10*a*, 10*b*, in an embodiment of the invention, the adjustment device 20*a* can bring about a change in the spacing 32 between the first outer lens plate 18 and the central lens plate 19 from a spacing according to FIG. 10*a*, 10*b* that corresponds to a minimum spacing, and wherein the entry side 30 of the central lens plate 19 and the exit side 29 of the first outer lens plate 18 are almost in contact or can almost come into contact, to a second, maximum spacing 32 according to FIG. 8*a*, 8*b*, wherein the two lens plates 18, 19 are spaced apart by approximately twice the focal length 25, 26. In this case, the lengthening can be achieved for example continuously, in particular steplessly, by the adjustment device 20*a*.

The light distribution generated on the building surface 17, in accordance with the different pacing positions of the two lens plates 18, 19 according to FIGS. 8*a*, 8*b*, 9*a*, 9*b* and 10*a*, 10*b* will be explained with reference to FIGS. 8*c*, 9*c* and 10*c*:

In the case of a spacing position according to FIGS. 8*a* and 8*b*, in which the spacing between the two lens plates 18, 19 corresponds to approximately twice the focal length 25, 26, the beam angle 27 is minimal. As can be seen from the schematic view of FIG. 8*a*, said angle is 0°, since the light is parallel. In fact, in view of the large actual spacing (not shown to scale in FIG. 1*a*) between the building surface 17 and the light fixture 10, the beam angle 37 is for example approximately 12 to 16°. Said beam angle already corresponds to the beam angle of the light emitted by the collimating optics 15.

If, using the adjustment device 20*a*, the two lens plates 18, 19 are moved toward one another, reducing the spacing 32, and for example an intermediate spacing according to FIG. 9*a*, 9*b* having a spacing 32 is reached, the central lens plate 19 can no longer maximally focus the light received from the first outer lens plate 18. FIG. 9*a*, 9*b* show that the lens element 23*b* can now focus the bundle of light rays received from the lens element 22*b* only to a lesser extent, and accordingly a second beam angle 38 is provided. Said second beam angle 38 is larger than the first beam angle 37.

Figure 8C:
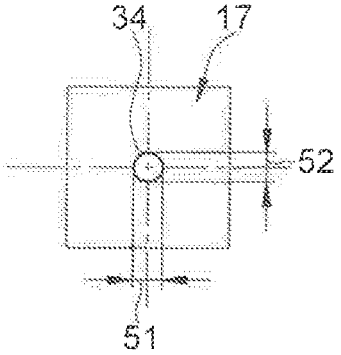
FIG. 8*c* is a schematic view of a building surface to be illuminated, having the light distribution, generated on the building surface by the light fixture of FIG. 8*a*, according to the spacing position of the two lens plates according to FIGS. 8*a* and 8*b*.

While FIG. 8*c* shows the light distribution that approximates a spot distribution, it is clear from FIG. 9*c*, in accordance with the spacing position of the lens plates 18, 19 according to FIG. 9*a*, that the light cone is widened. The width 51*b* of the light distribution according to FIG. 9*c* is larger than the width 51 of the light distribution according to FIG. 8*c*.

However, the height 52 of the light distribution is unchanged.

Whereas, proceeding from a spacing position according to FIG. 9*a*, 9*b*, the two lens plates 18, 19 are moved closer toward one another, and contact or approximately a contact position according to FIG. 10, 10*b* is achieved, no or virtually no collimating of the light received from the first lens plate 18 takes place by means of the central lens plate 19. In this case, the beam angle 39 is significantly larger than the beam angle 38 in the spacing position according to FIG. 8*a*, 8*b*, 9*a*, 9*b*.

Figure 10C:
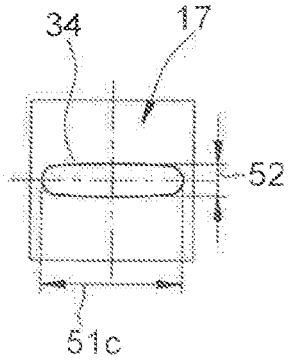
FIG. 10*c* is a view according to FIG. 9*c* of the light distribution in the event of a spacing position of the lens plates according to FIGS. 10*a* and 10*b*, FIG. 11*a*, 11*b* and 11*c* are views according to FIGS. 8*a*, 8*b* and 8*c* of the light fixtures when the lens plates are at a maximum mutual spacing.

The light distribution on the wall 17 according to FIG. 10*c* accordingly has an even larger width 51*c*, compared with the light distribution curve 17 according to FIG. 8*c*.

A maximum oval light distribution is achieved in this case.

In this respect, changing the spacing between the lens plates 18, 19, and the fixed association of the lens elements 22*a*, 22*b*, 22*c* of the first lens plate 18 with the lens elements 23*a* 23*b*, 23*c* of the second lens plate 19 can result in a change in the emission characteristics of the light fixture 10, in particular a change in the beam angle 37, 38, 39 or a change in the ovality or the ovacity of the light distribution 34.

During the spacing change, the rotational peripheral position of the central lens plate 19 relative to the first lens plate 18 is maintained even during the adjustment process, by means of a positioning device (not shown). This ensures that the fixed association of one specific lens element 22*a*, 22*b*, 22*c*, in each case, on the first outer lens plate 18 with a plurality of specific lens elements 23*a*, 23*b*, 23*c*, in each case, on the central lens plate 19, is maintained for different spacings 32.

Figure 5:
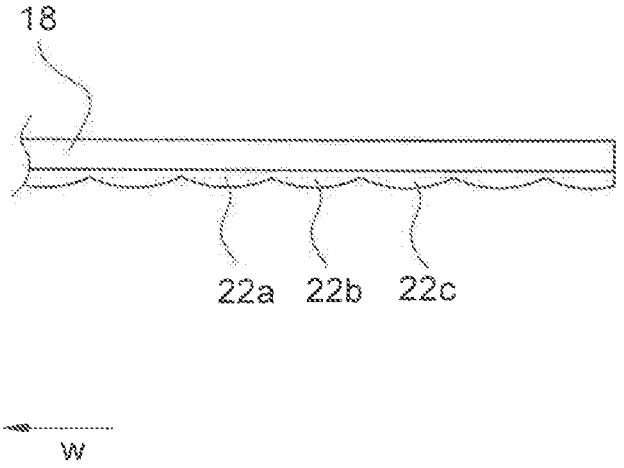
FIG. 5 is a partially cut away schematic view of the first outer lens plate, approximately according to the cutting line V-V in FIG. 4.

It is clear from FIGS. 4 and 5 that, in this embodiment, the first outer lens plate 18 comprises lenticular lenses in each case. These are cylindrical lenses that have spherical or aspherical curvatures along a first sectional plane (cf. FIG. 5), and those along a second sectional plane perpendicular to the first sectional plane are not curved. In this respect, the lenticular lenses 22*a*, 22*b*, 22*c* are symmetrical, and are oriented so as to be mutually parallel.

Figure 6:
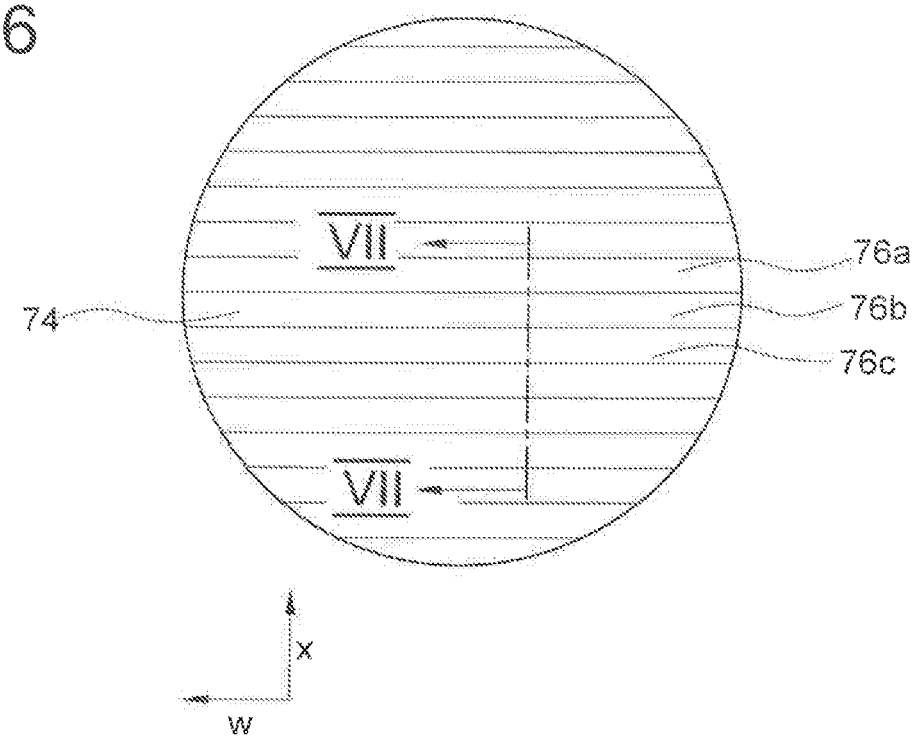
FIG. 6 is a view comparable to FIG. 4, approximately in accordance with the elevation arrow VI in FIG. 1*a*, of an embodiment of a second outer lens plate according to the invention.
Figure 7:
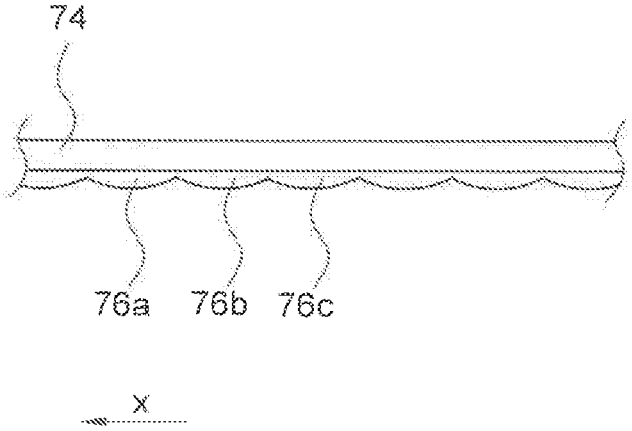
FIG. 7 is a partially cut away schematic view of the second outer lens plate, approximately along the cutting line VII-VII in FIG. 6.

It is clear from the embodiment of FIGS. 6 and 7 the second outer lens plate 74 also comprises lenticular lenses that are denoted merely by way of example, by reference sign 76*a*, 76*b*, 76*c*.

The lenticular lenses of the second outer lens plate 74 are arranged in a direction W that is perpendicular to the direction X, in which the lenticular lens elements 22*a*, 22*b*, 22*c* of the first outer lens plate 18 according to FIGS. 4 and 5 are arranged.

FIGS. 8*a* to 10*c* have already been described above.

In the following, it will be explained, with reference to FIG. 11*a* to 13*c*, that the spacing 75 between the second outer lens plate 74 and the central lens plate 19 can be changed by means of a second adjustment device 20*b*, while maintaining the maximum spacing 32 between the first outer lens plate 18 and the central lens plate 74.

FIG. 11*a* to 13*c* show three different spacing positions of central lens plates 19 and second outer lens plates 74, as well as the light distribution generated on building surface 17 in each case.

Figure 11A:
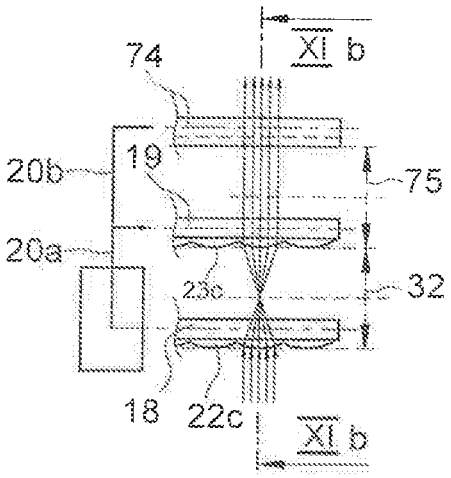
Figure 11B:
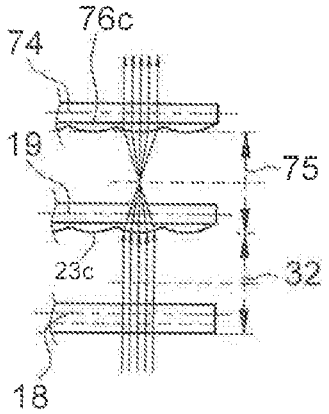
Figure 11C:
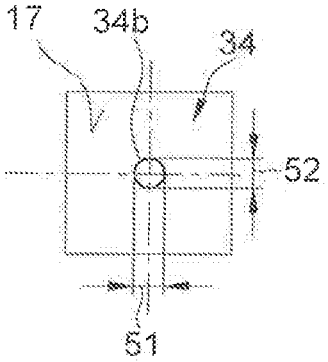
Figure 12A:
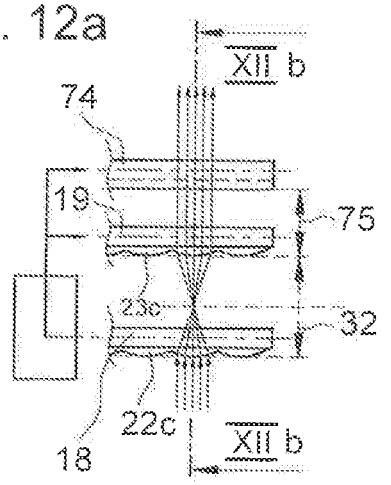
FIGS. 12*a*, 12*b* and 12*c* are views of the light fixtures that correspond to the views of FIG. 11*a*, 11*b* and 11*c*, wherein the spacing between the central lens plate and the second outer lens plate has been reduced, while the spacing between the first outer lens plate and the central lens plate is unchanged.
Figure 12B:
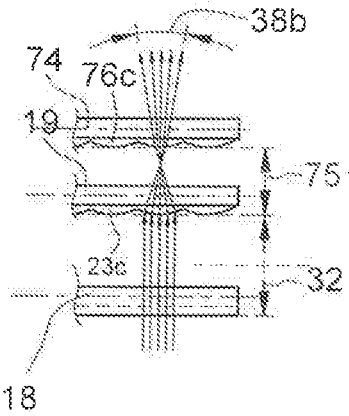
Figure 13A:
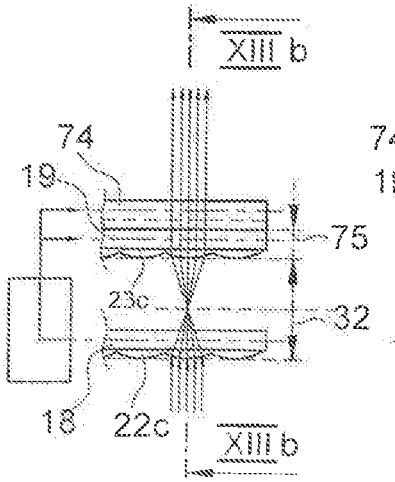
FIGS. 13*a*, 13*b* and 13*c* are views of the light fixtures that correspond to the views of FIG. 11*a*, 11*b* and 11*c*, wherein the relative spacing between the central lens plate and the second outer lens plate is minimized, while the spacing between the first outer lens plate and the central lens plate is unchanged.
Figure 13B:
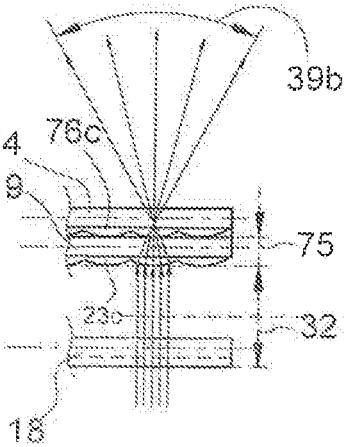

It can be seen that, as the spacing decreases, proceeding from the position of FIG. 11*a*, 11*b*, to the spacing position of the lens plates 19, 74 according to FIGS. 12*a* and 12*b* and further with respect to a contacting position of the lens plates 19 and 74 according to FIGS. 13*a* and 13*b*, the light distribution becomes increasingly elongate or oval. In this case, the height 52, 52*b*, 52*c* of the light distribution changes, wherein the width 51 of the light distribution 34 does not change.

It can be seen, with reference to the light distributions 34 of FIG. 11*a* to 13*c*, that the light fixture generates an oval light distribution in each case, at different spacing positions of the two lens plates 19, 74. An oval light distribution or illumination intensity distribution on the wall 17 is understood, in a manner conventional for a person skilled in the art, to be a light distribution that has a contour 53 that deviates from a circular shape of a light distribution, as shown according to FIG. 8*c* for example.

Figure 12C:
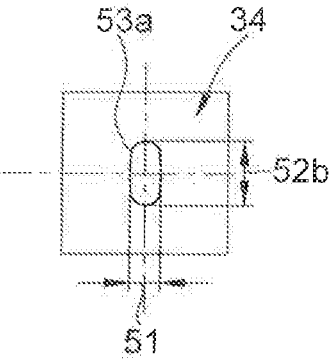

For example, FIG. 12*c* shows an oval light distribution 34 having a correspondingly ova contour 53*a*, and a light distribution (shown in a simplified manner) that has a width 51 of the light distribution and a height 52*b* of the light distribution. The light distribution is therefore oval, or approximately elliptical. The exact contour 53*a* of the light distribution 34 of course depends on the lens element radii of curvature that are used.

Figure 13C:
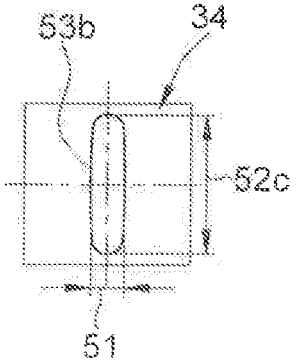

As the spacing between the two lens plates 19, 74 decreases, the light distribution 34 on the building surface 17 to be illuminated becomes higher, at a constant width. FIG. 13*c* shows the light distribution 53*b* on the building surface 17 to be illuminated, which light distribution corresponds to the spacing position of the two lens plates 19, 74 according to FIGS. 13*a* and 13*b*. It can be seen that the height 52*c* of said light distribution is significantly greater than the height 53 of the light distribution 34 of FIG. 11*c*. This effect results from the lens elements (denoted, by way of example, 76*a*, 76*b*, 76*c*) of the second lens plate 74 in each case no longer being able to collimate the partial bundle of rays, received from the lens elements 23*a*, 23*b*, 23*c* of the central lens plate 19, as effectively or as completely as in the case of the spacing position shown in FIGS. 11*a* and 11*b*.

The decisive factor is that the height 52 of the light distribution 34 is changed by changing the spacing 75 between the lens plates 19 and 74, and thus the beam angle 38*b*, 39*b* in the sectional plane of FIG. 11*b* and 12*b* is thereby increased.

In a sectional plane, perpendicular thereto, of FIG. 11*a* and 12*a*, the beam angle is not influenced. This is the reason why the width 51 of the light distribution 34 virtually does not change, and only the height 52, 52*b*, 52*c* varies.

The following will now be explained with reference to FIGS. 14*a* to 16*c:*

In this case, the spacing 32 of the first outer lens plate 18 from the central lens plate 19, and the relative spacing 75 between the second end plate 74 and the central lens plate 19 can be changed simultaneously.

Figure 14A:
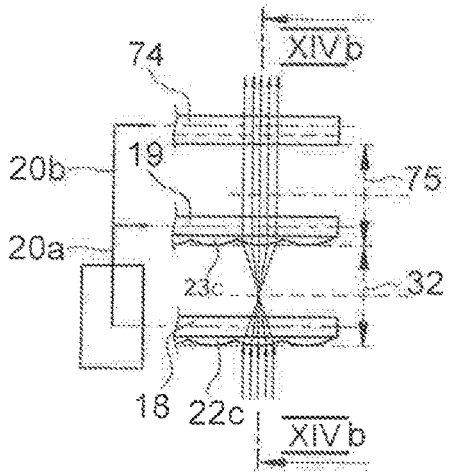
FIGS. 14*a*, 14*b* and 14*c* are views of the light fixtures that correspond to the views of FIGS. 8*a*, 8*b* and 8*c*, wherein in each case a maximum spacing between the central lens plate and the two outer lens plates is achieved.
Figure 14B:
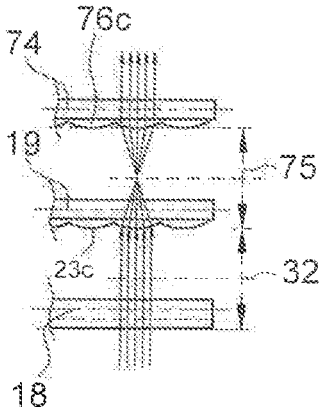
Figure 15A:
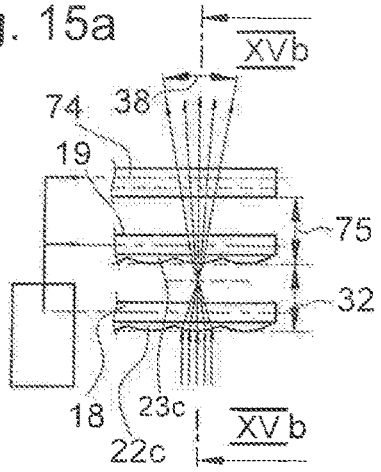
FIGS. 15*a*, 15*b* and 15*c* are views of the light fixtures that correspond to the views of FIGS. 14*a*, 14*b* and 14*c*, wherein both the relative spacing between the first outer lens plate and the central lens plate, and the spacing between the second outer lens plate and the central lens plate is reduced.
Figure 15B:
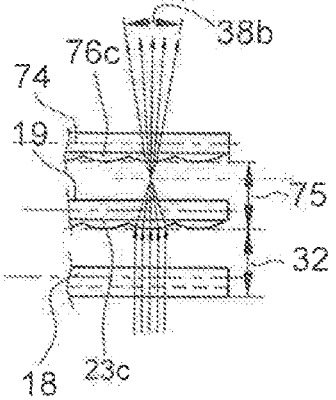
Figure 16A:
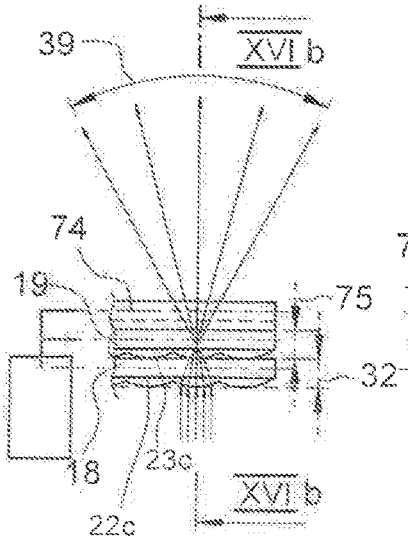
FIGS. 16*a*, 16*b* and 16*c* are views of the light fixtures that correspond to the views of FIGS. 14*a*, 14*b* and 14*c*, wherein the spacing between the first outer lens plate and the central lens plate, and the spacing between the second outer lens plate and the central lens plate is minimized.
Figure 16B:
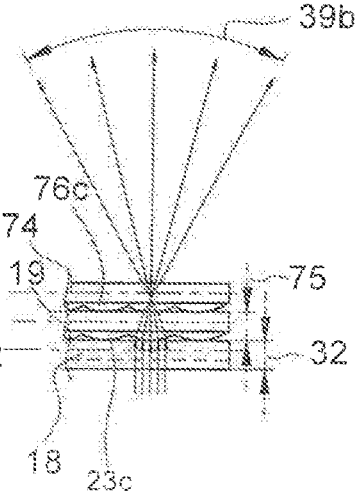

FIGS. 14*a* and 14*b* show a maximum spacing position, FIGS. 16*a* and 16*b* show a contact position, and FIGS. 15*a* and 15*b* show an intermediate position.

Figure 14C:
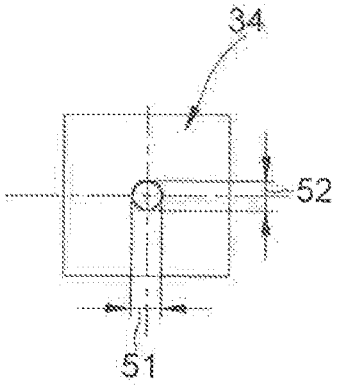
Figure 15C:
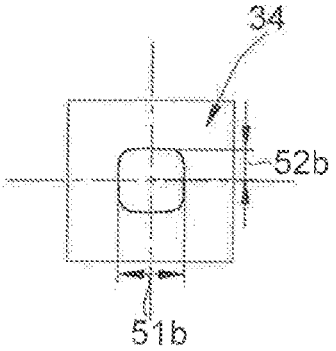
Figure 16C:
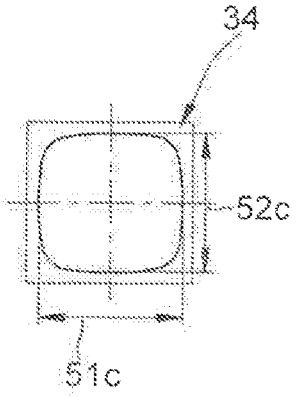

The light distribution 34 according to FIGS. 14*c*, 15*c* and 16*c* corresponds to the spacing positions of the lens plates.

It can be seen that a spot distribution according to FIG. 14*c* that, in the two sectional planes of FIGS. 14*a* and 14*b*, strikes the building surface 17 as a maximally narrow light beam, widens to a light distribution contour according to FIG. 15*a* and FIG. 16*c*, in the direction of the height 52 and in the direction of the width 51.

Figure 1B:
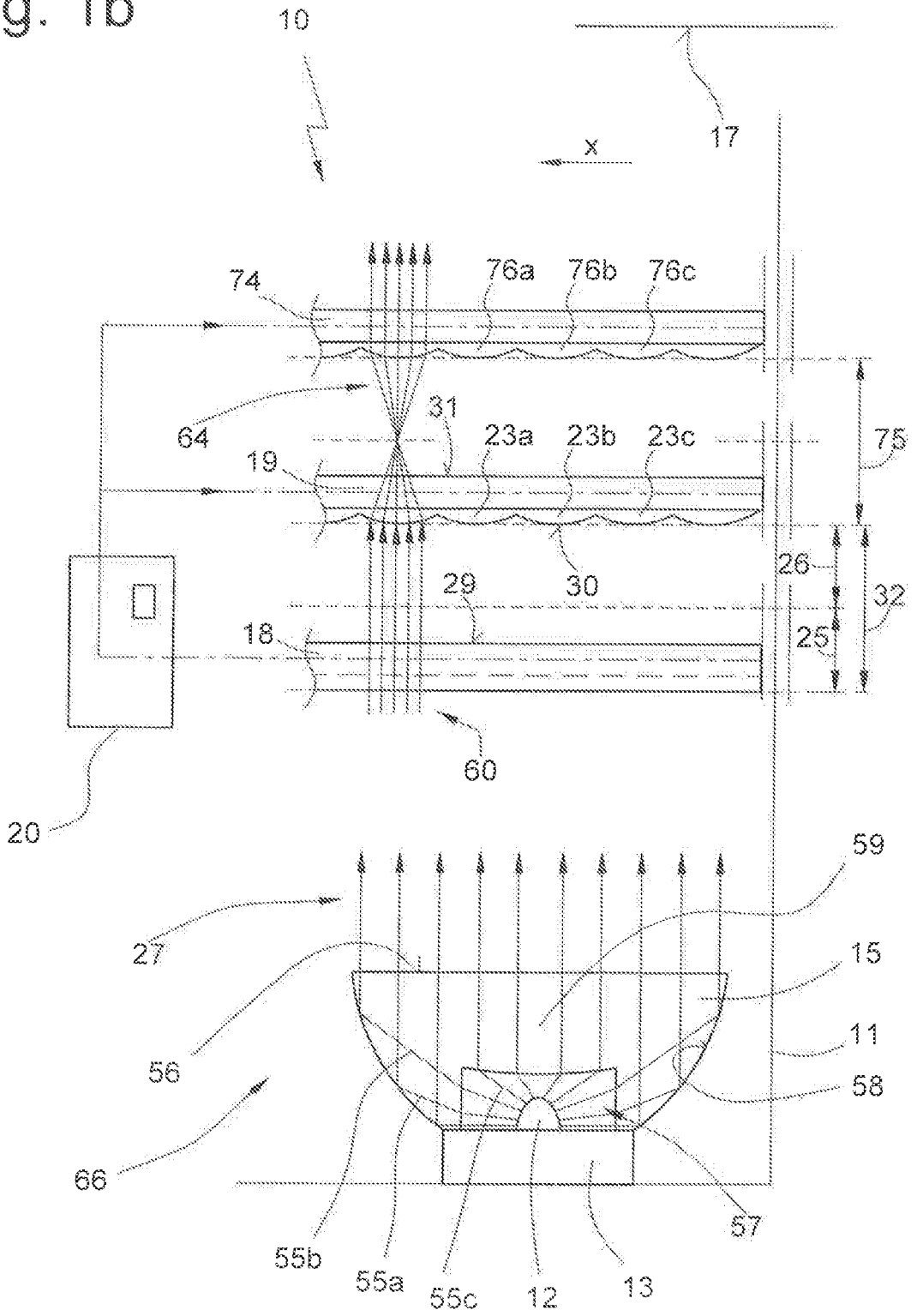
FIG. 1*b* is a schematic, partially cut away view, approximately according to the cutting line Ib-Ib in FIG. 1*a*, of the light fixture of FIG. 1*a*.

In this respect, a light fixture according to FIGS. 1*a* and 1*b* can achieve oval light distributions, the ovality of which, i.e. the degree of ovality of which, can be adjusted. In this case, the width of the oval light distribution or the height of the oval light distribution can be adjustable in different axial directions. As is clear from the light distribution 34 according to FIGS. 14*c*, 15*c* and 16*c*, the light fixture can simultaneously also generate a light distribution that deviates from the oval light distribution, e.g. in the manner of a circle or a rounded square.

The invention of course also covers embodiments of light fixtures that can generate light field contours other than those shown.

Figure 17:
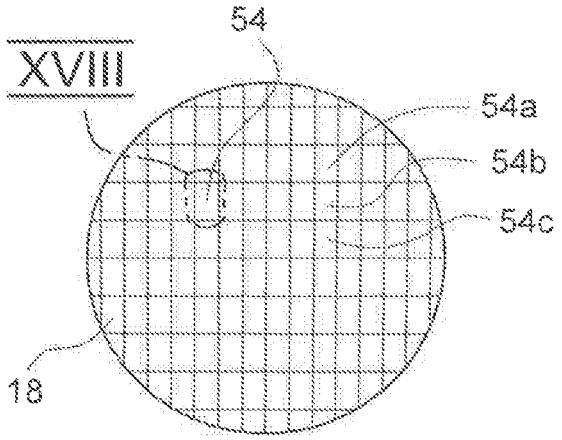
FIG. 17 is a view according to FIG. 4 of a further embodiment of a first outer lens plate according to the invention, using lenticular facets.

A further embodiment of a light fixture 10 according to the invention will now be explained with reference to FIGS. 17 to 20:

FIG. 17 shows a further embodiment, in a view according to FIG. 4, of a first outer lens plate 18 that now comprises what are known as lenticular facets 54*a*, 54*b*, 54*c*. These are facets that can for example have a more complex curvature.

It is clear from FIGS. 17 to 20 that facets 54*a*, 54*b*, 54*c* can be arranged along a specified grid. In this case, it is possible in particular for the arrangement of said facets 54*a*, 54*b*, 54*c* according to the drawing in FIG. 17 to be along a grid that comprises rows and columns. In this case, the number of columns can be such as to correspond to the number of lenticular lenses of a lens plate 18 according to FIG. 4.

In this case, each column of said facet arrangement can be divided into a plurality of individual facets.

Said lenticular facets can have a particularly curved surface having different radii of curvature.

Figure 18:
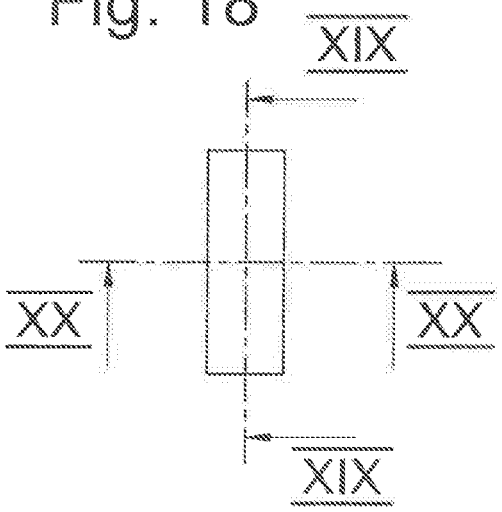
FIG. 18 is an enlarged schematic detail view of a single lenticular facet according to the partial circle XVIII in FIG. 17.

FIG. 18 is an enlarged detail view of a single lenticular facet 54 from the lens plate 18 according to FIG. 17. It is clear from the two cross sections of FIGS. 19 and 20 that different radii of curvature can be provided along different, mutually perpendicular sectional planes. In this case it is assumed, for the sake of simplicity, that all the facets 54*a*, 54*b*, 54*c* of the lens plate 18 are designed identically.

Figure 19:
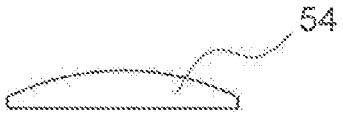
FIG. 19 is a partially cut-away view through the facets of FIG. 18, along the cutting line XIX-XIX in FIG. 18.
Figure 20:
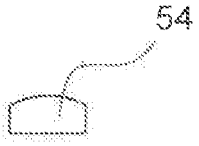
FIG. 20 is a partially cut-away view through the facets of FIG. 18, along the cutting line XX-XX in FIG. 18.

It should furthermore be noted that the facets according to the cross sections of FIGS. 19 and 20 have radii of curvature, wherein it is clear to a person skilled in the art that other curved surfaces, such as elliptical or parabolic curvatures, can be used.

The invention further relates to the case where entirely different facets are arranged on one lens plate or on a plurality of lens plates, e.g. using freeform surfaces calculated from simulations.

In the embodiments of the invention, a lens plate comprising lenticular lens facets, as shown in FIG. 17, can also be provided as a central lens plate 19 or as a second outer lens plate 74.

In the embodiments of the invention, the spacing of the three lens plates 18, 19, 74 relative to one another can be changed by means of an axial movement, wherein the lens plates are oriented so as to be mutually parallel in any spacing position. The invention also relates to the case where, instead of a change in spacing of this kind among the lens plates 18, 19, 74, a displacement movement is performed by means of the adjustment device 20*a*, 20*b* such that, in addition to an axially directed, parallel displacement movement, or alternatively to a movement of this kind, a mutual spacing change among the lens plates 18, 19, 74 is achieved in that one of the lens plates 18, 19, 74 is rotated, tilted or inclined, or subjected to another, possibly more complicated, movement, with respect to another lens plate 19, 18, 74 in each case. It is possible to ensure here, too, that an association between at least one lens element, in each case, of a lens plate, and at least one other lens element of another lens plate is fixedly maintained.

The invention also relates to embodiments in which said association is eliminated during a spacing change, and for different lens elements of a first lens plate, in each case, to be associated with different lens elements of a second lens plate, for example in discrete, different spacing positions.

Ultimately, the drawings exclusively show embodiments in which the rotational position of the central lens plate 19 relative to the first outer lens plate 18 and the second outer lens plate is maintained during a spacing change. However, the invention also relates to embodiments in which a spacing change between the lens plates 18, 19, 74 results in a change in the rotational position of the central lens plate 19 relative to the two outer lens plates 18, 74.

The method for changing the emission characteristics of a light fixture can be performed as follows:

It is assumed that, in a museum, an art installation of a specified format is illuminated for the duration of a temporary exhibition. After said exhibition has ended, a new art installation having a different format is intended to be illuminated by the same light fixture on the same or another building surface. In order to adjust the light distribution of the light fixture to said format change of the art installation, the spacing of the three lens plates 18, 19, 74 relative to one another can be changed in the desired manner, by an operator, using the adjustment devices 20*a*, 20*b*.

The change in the light distribution or the emission characteristics of the light fixture can be performed without elements of the light fixture needing to be exchanged or replaced, or even the light head of the light fixture needing to be exchanged or replaced.

In the embodiments of the invention, an axial displacement of the first outer lens plate 18 and/or the second outer lens plate 74 relative to the central lens plate 19 takes place along an adjustment path that is approximately twice the focal length 25 of the lens elements 22*a*, 22*b*, 22*c*, 76*a*, 76*b*, 76*c* of the first outer lens plate 18 and the second outer lens plate 74. The invention also relates to embodiments in which the adjustment path that is provided by the adjustment device 20*a*, 20*b* for changing the spacing 32, 75 between the lens plates 18, 19, 74 is slightly or significantly greater or slightly or significantly smaller in comparison therewith.

In the event of the lens elements 22*a*, 22*b*, 22*c* of the first lens plate 18 providing different focal lengths 25, the displacement path to be provided on the adjustment device 20*a* can be oriented to the focal length or twice the focal length 25 of one of the facets 22*a*, 22*b*, 22*c*.

Advantageously, the displacement path to be provided by the adjustment device 20*a*, 20*b* is dimensioned such that a change in spacing between one pair of the lens plates 18, 19, 74 is provided, between a first optimized spacing in which a minimum beam angle, i.e. approximately parallel light, is generated, and a second spacing position, which generates a maximum beam angle, specified by the curvature of the lens elements.

These two different spacing positions between the lens elements 18, 19 or 19, 74 that accordingly provide a maximum beam angle and a minimum beam angle can also be specified or predetermined by stops provided by the adjustment device 20*a*, 20*b*, and accordingly define a displacement movement of the first and second outer lens plate 18, 74 relative to the central lens plate 19.

In the event of the change in spacing between the lens plates 18, 19, 74 being intended to be performed in discrete steps, in order to ensure specified spacing positions between the lens plates 18, 19, 74 (for example in order to allow for specified optimized, e.g. particularly homogeneous, light distributions), latching positions, i.e. positions in which the spacing positions between the lens plates 18, 19, 74 can be identified or determined by an operator or by an electronic or mechanical sensor or a control unit, can also be specified along the displacement path. As a result, it is possible to exclude the possibility, for example, of specific intermediate positions between specified latching positions not being reached.

According to the embodiments of the invention, conventional LEDs 12, 12*a*, 12*b*, 12*c* and conventional collimating optics 15, 15*a*, 15*b*, 15*c* can be used. In this case, it is possible to use lens elements 23*a*, 23*b*, 23*c* that are aspherical but can be described approximately by a sphere, wherein the sphere can have diameters of curvature of between 1 and 50 mm for example.

For example adjustment paths of between 2 and 40 mm, preferably adjustment paths in an order of magnitude of approximately 4 to 6 mm are provided as typical adjustment paths that are to be provided by the adjustment device 20 and along which a spacing change among the lens plates 18, 19, 74 can take place.

In order to prevent disintegration of the structures of the LED 12 and the collimating optics 15, in order to generate an illumination intensity distribution or light distribution on the building surface 17 that is as homogenous as possible, approximately 10 to 50 lens elements 23*a*, 23*b*, 23*c* are provided on the central lens plate 19 per collimating optics 15, 15*a*, 15*b*, 15*c* and/or per LED 12, 12*a*, 12*b*, 12*c* and/or LED group, for example in the event of using a multichip LED. As a result, particularly optimized homogenization of the emitted light can be achieved.

It is clear from the embodiments that the collimating optics 15 comprises a cavity 57, total internal reflection surfaces 58 and a cover region 59, i.e. a conventional lens centrally in the middle of the collimating optics 15. Differently designed suitable collimating optics that focus the light emitted by the corresponding light source are also covered by the invention.

According to the invention, conventional lens plates 18, 19, 74 can be used for providing a light fixture 10 according to the invention, which lens plates have been used by the applicant for a considerable time e.g. as tertiary optics in light fixtures.

Figure 21:
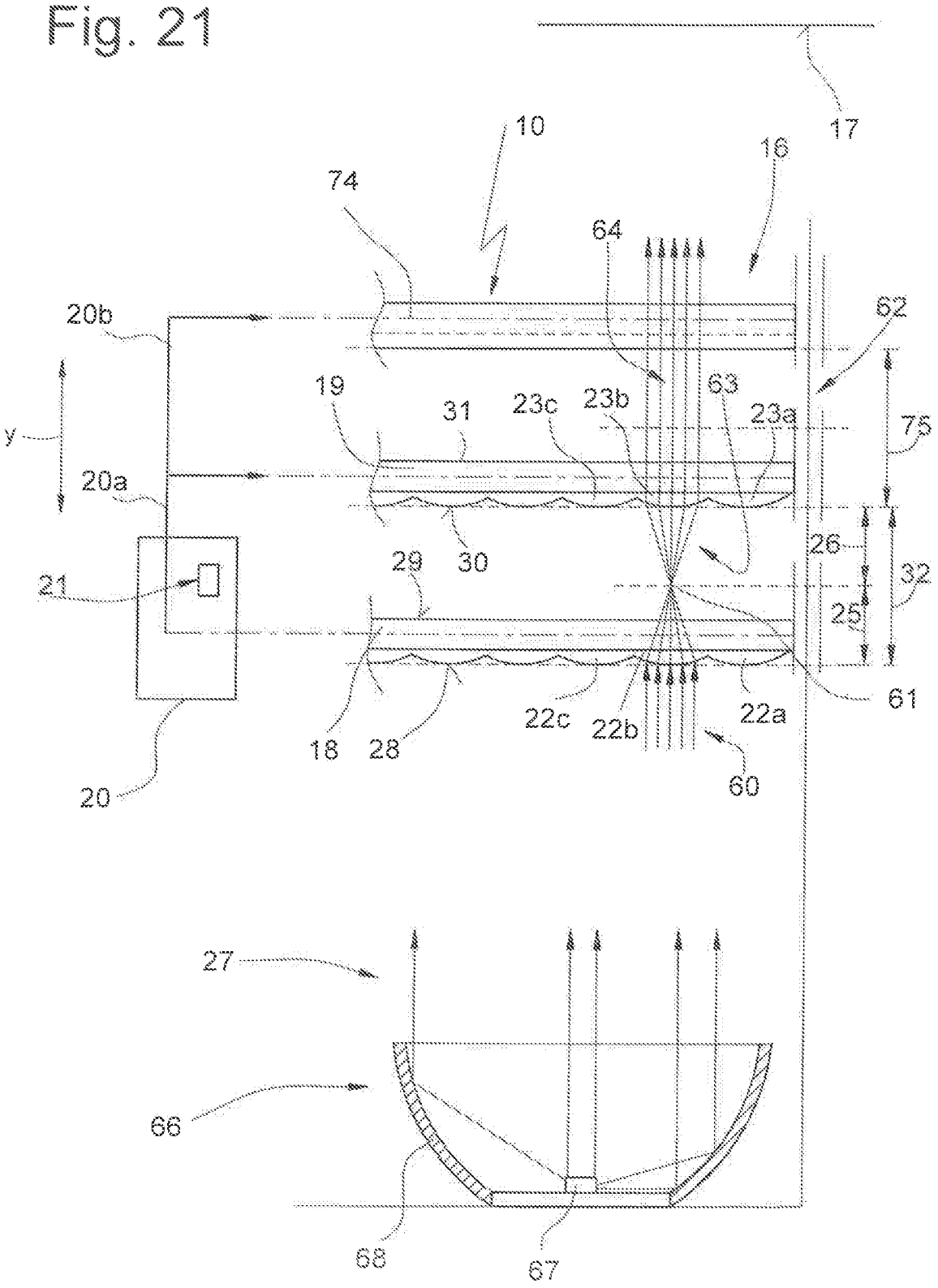
FIG. 21 is a view according to FIG. 1*a* of a further embodiment of a light fixture, wherein, in this embodiment, the light drive is provided by a chip on board LED, and a reflector is provided as the collimating optics.

In the embodiment of FIG. 21, reference is also briefly made to a further embodiment, the illustration of which in FIG. 21 corresponds to the illustration of FIG. 1*a*. In this case, collimating optics are provided that replace the collimating optics 66 of FIG. 1. In the embodiment of FIG. 21, a reflector 68 is provided as collimating optics 66, which reflector interacts with an assembly of a chip on board LED 67 that is arranged inside the reflector 68 or is associated with a reflector 68. The reflector 68, together with the chip on board LED 67, also emits a beam of light rays 27 of parallel or approximately parallel light.

In the embodiment of FIG. 21, the three lens plates 18, 19, 74 can be arranged in the same manner as in the embodiment of FIG. 1. At different spacings 32, the light distribution of the light fixture 10 corresponds to the changed light distributions as can be seen in FIG. 8*a*-16*c*.

Figure 22:
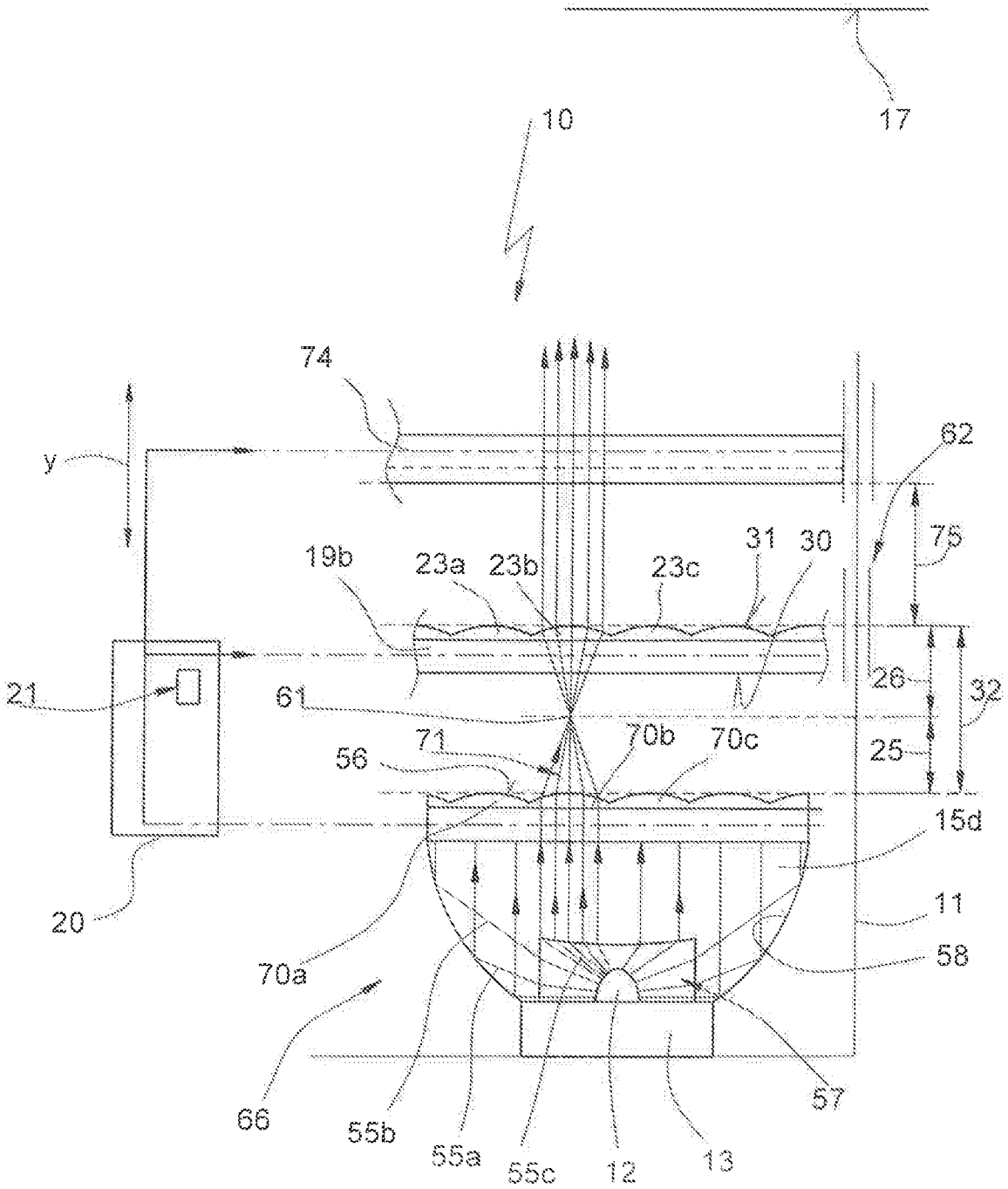
FIG. 22 is a view according to FIG. 1 of a further embodiment of a light fixture according to the invention, wherein in this case, instead of three lens plates, collimating optics comprising lens elements directly attached thereto and two lens plates arranged at a spacing that can be changed relative thereto is provided.

According to a further embodiment of a light fixture 10 according to the invention according to FIG. 22, collimating optics 66 are provided that comprise collimating optics 15*d* comprising lens elements 70*a*, 70*b*, 70*c* in the manner of lenticular lenses arrange directly thereon. The lens elements 70*a*, 70*b*, 70*c* are thus arranged on the light exit side 56 of the collimating optics 15*d* that, unlike in the case of the embodiment of FIG. 1*a*, is not kept smooth but rather comprises the plurality of lens elements 70*a*, 70*b*, 70*c*.

On the basis of a bundle of light rays 71 by way of example, it can be seen from FIG. 22 that the light emission behavior of said light fixture corresponds to that of the embodiment of FIG. 1*a*.

The second lens plate 19*b* of the embodiment of FIG. 22 corresponds to the central lens plate 19 of the embodiment of FIG. 1*a*. It is irrelevant that in this case the lens elements 23*a*, 23*b*, 23*c* are arranged on the light exit side 31 of the lens plate 19*b*, and the lens entry side 30 is kept planar. In the embodiment of FIG. 22, the orientation of the central lens plate 29*b* could also be reversed.

At different spacing positions of the lens plate 19*b* relative to the collimating optics 15*d* of the embodiment of FIG. 22, exactly the same changes in the emission characteristics of the light fixture result as are shown in FIGS. 8*a* to 16*c* on the basis of the embodiment of FIG. 1*a*.

It is furthermore clear that the lens plate 19*b* can also cover a plurality of corresponding collimating optics 15*d*.

Figure 23:
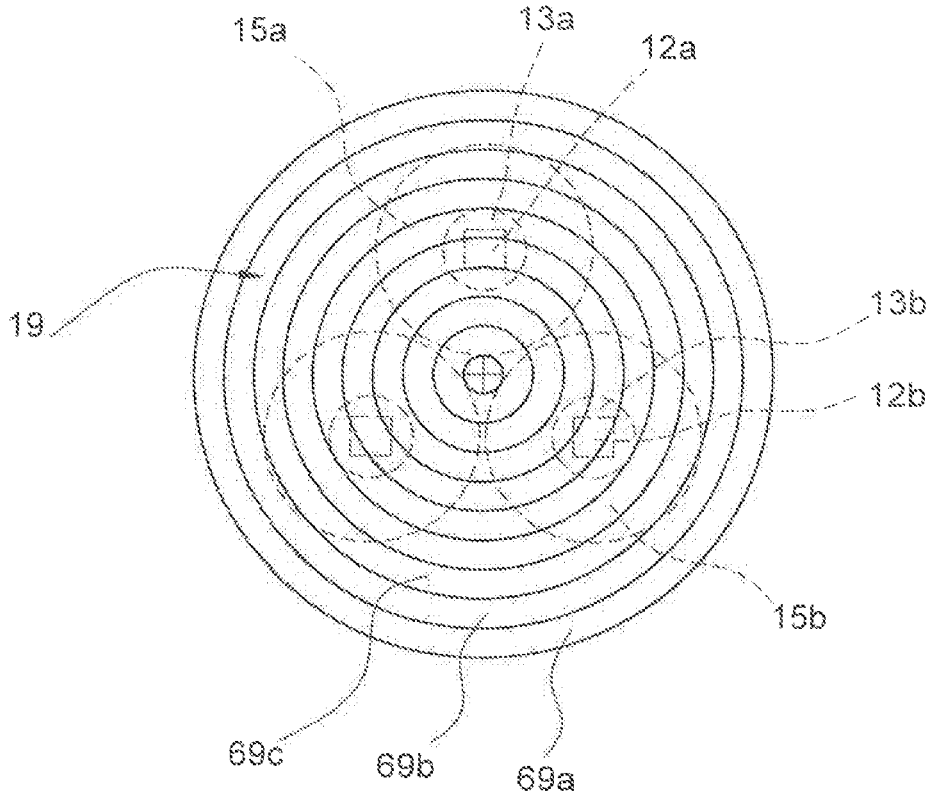
FIG. 23 is a view according to FIG. 4 of a further embodiment of a central lens plate according to the invention, using concentrically arranged annular lenticular lenses.

The embodiment of FIG. 23 shows a further central lens plate 19. In this case the drawing in FIG. 23 corresponds to the drawing in FIG. 2.

Instead of facet-like lens elements 23*a*, 23*b*, 23*c* according to the embodiments of FIGS. 2 to 3, in this case circular, concentric lenticular lens elements 69*a*, 69*b*, 69*c* are provided.

In the embodiment, a central lens plate 19 is used, as is shown in FIG. 23. In this case, for example the same cross sectional view results as is indicated schematically, and not to scale, in FIG. 1*a*.

If the central lens plate 19 according to FIG. 23 is arranged in different spacing positions relative to the two outer lens plates 19, 74, the identical light distributions result according to FIGS. 8*a* to 16*c* as in the embodiment of FIG. 1*a*.

According to a further embodiment of the invention that is not shown, one or more of the three lens plates 18, 19, 19*b*, 74 are curved or bulged differently from that show in the various embodiments of the patent application.

Alternatively, as shown in the drawings, the lens plates 18, 19, 74 can each be oriented along a plane.

Figure 24:
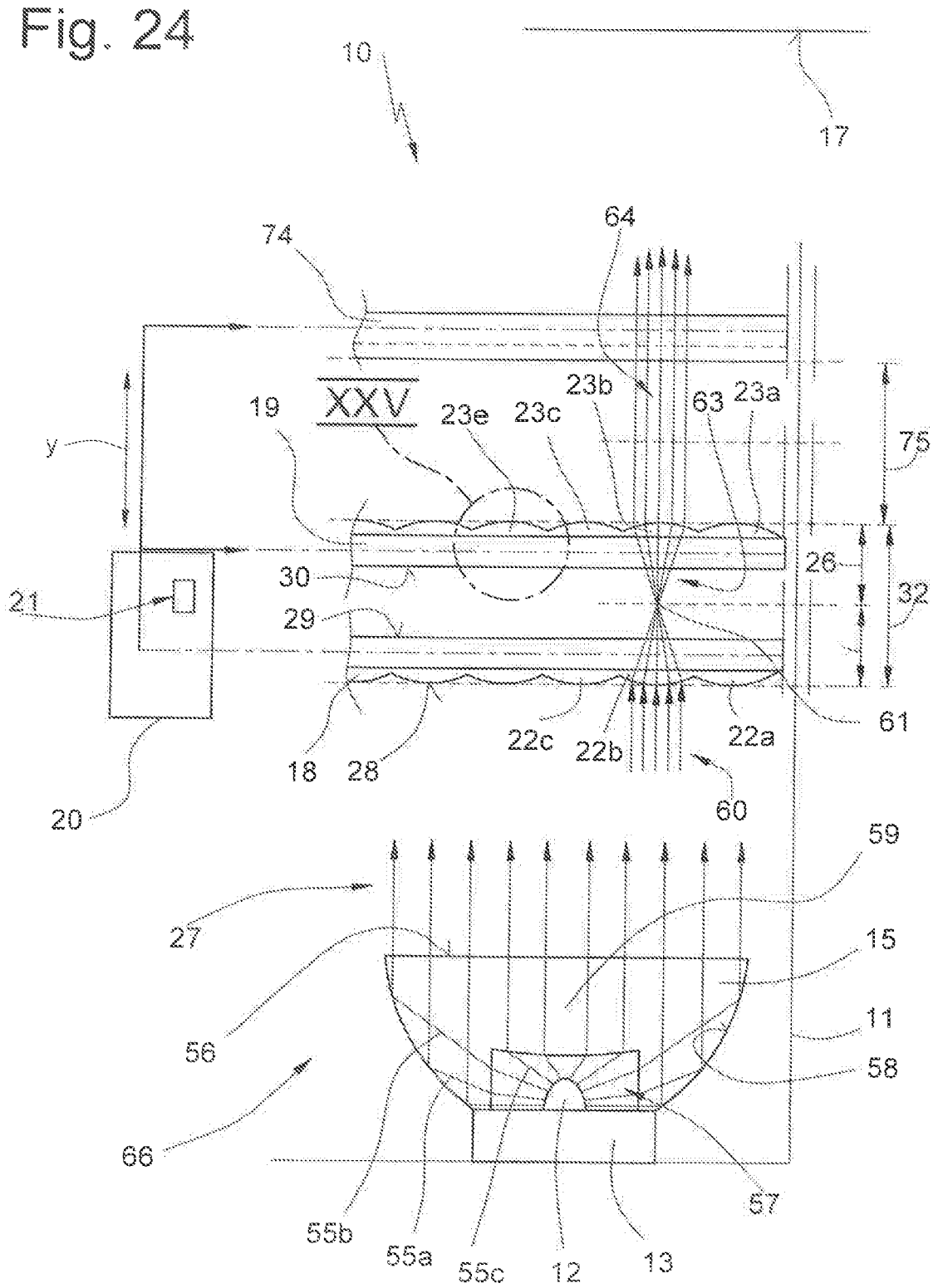
FIG. 24 is a view according to FIG. 1*a* of a further embodiment of a light fixture according to the invention, wherein, in a manner different from the view of FIG. 1*a*, the central lens plate is arranged so as to be rotated by 180° or geometrically inverted, and therefore the lens elements of the central lens plate are turned away from the collimating optics.

According to the embodiment of FIG. 24, the lens elements of a pair of adjacent lens plates can also be arranged so as to face away from one another, such that for example the lens elements 22*a*, 22*b*, 22*c* of the first outer lens plate 18 face the collimating optics 15, and the lens elements 23*a*, 23*b*, 23*b* of the central lens plate 19 are arranged on the side of the second lens plate 19 that faces away from the collimating optics 15.

Figure 26:
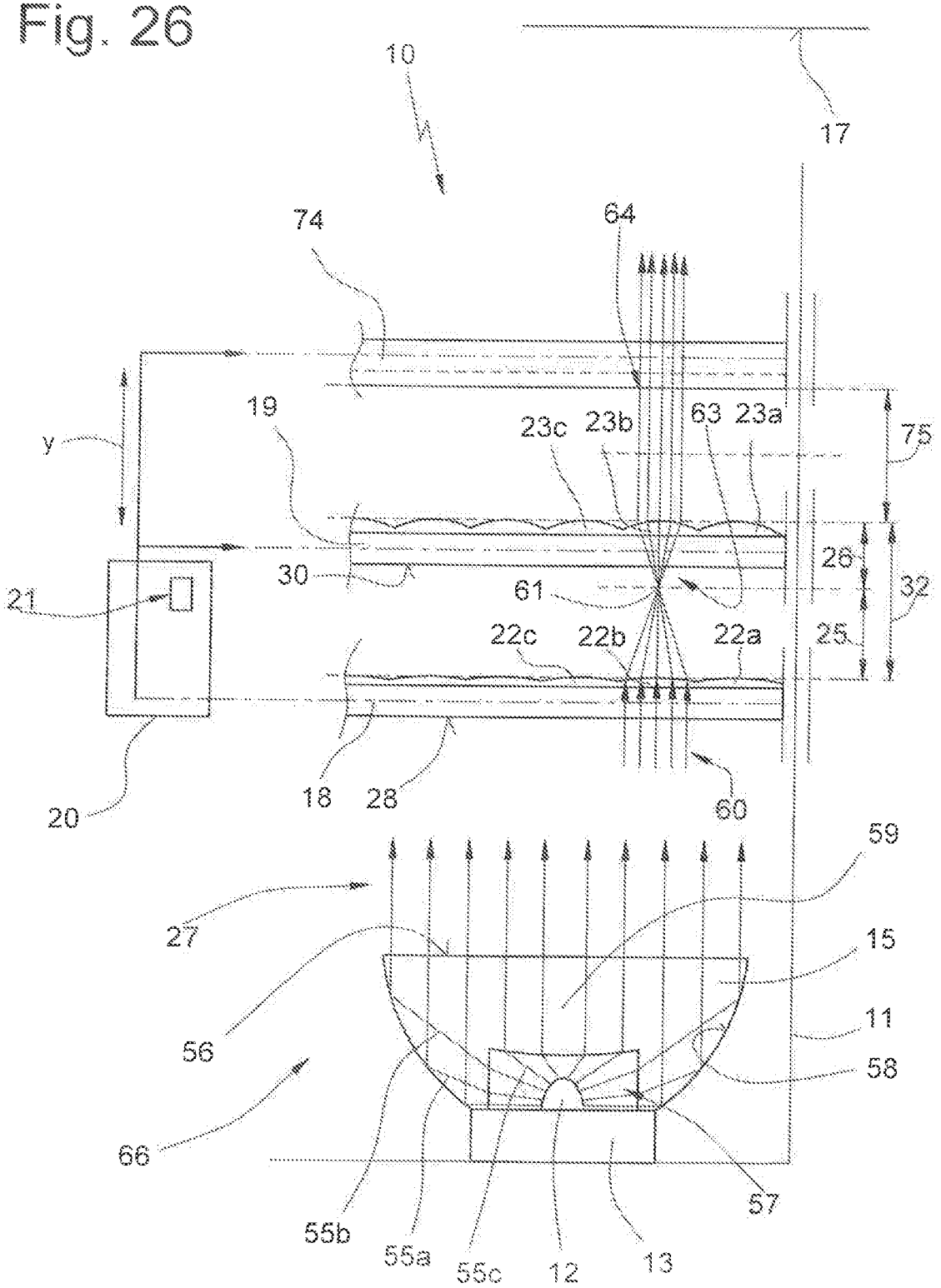
FIG. 26 is a view according to FIG. 1*a* of a further embodiment, wherein the lens elements of the first outer lens plate close to the collimating optics have a larger radius, and the lens elements of the central lens plate have a comparatively smaller radius.

Finally, the embodiment of FIG. 26 is based on the basic structure of the embodiment of FIG. 24. In this case however, in contrast with the embodiment of FIG. 24, the lens elements 22*a*, 22*b*, 22*c* of the first outer lens plate 18 are provided with a first radius, such that the corresponding lens elements 22*a*, 22*b*, 22*c* can be assigned a first focal length 25.

The lens elements 23*a*, 23*b*, 23*c* of the central lens plate 19 have a smaller radius in comparison, such that each lens element 23*a*, 23*b*, 23*c* of the central lens element 19 can be assigned a focal length 26 that is smaller than the focal length 25. This is a particularly advantageous embodiment.

According to the invention, the group of features according to which the lens elements 22*a*, 22*b*, 22*c* of the first outer lens plate 18 all, or mostly, or at least on average, have a larger radius and/or a larger focal length than the lens elements 23*a*, 23*b*, 23*c* of the central lens plate 19 can be used advantageously in all the embodiments.

The advantage of this particular geometry is inter alia that the bundle of light rays emitted by a specified lens element (e.g. 22*b*) of the first lens plate 18 is actually highly likely to also strike only specific accordingly opposing lens elements 23 of the central lens plate 19.

It should be noted that the differences in the focal lengths or the differences in the average focal lengths between the lens elements 22*a*, 22*b*, 22*c* of the first outer lens plate 18 and the lens elements 76*a*, 76*b* of the second outer lens plate 74 and the lens elements 23*a*, 23*b*, 23*c* of the central lens plate 19 can be several millimeters. It is thus possible, for example, for the focal length of the lens elements 22*a*, 22*b*, 22*c* of the first outer lens plate 18 to be between 3 mm and 10 mm, and the focal length 26 of the lens elements 23*a*, 23*b*, 23*c* of the central lens plate 19 to be between 0.5 mm and 2.9 mm.

Figure 25:
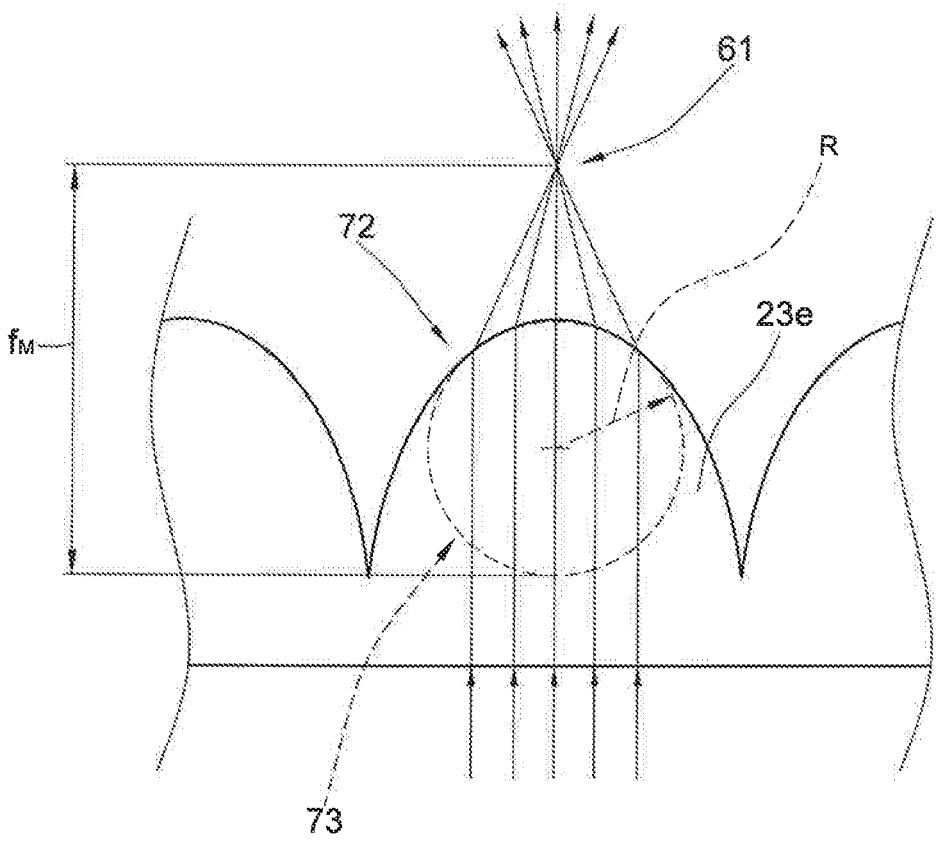
FIG. 25 is a partially cut away, truncated, schematic view of a detail of the central lens plate according to FIG. 24, approximately according to the partial circle XXV in FIG. 24.

The embodiments of FIGS. 3 and 25 are intended to also schematically explain that an individual lens element, e.g. the lens element 23*e*, can be formed not necessarily by a sphere, but rather also by a rotational paraboloid. However, the cap region 72 (FIG. 25) of each rotational paraboloidal lens element 23*e* can be described approximately by a circle 73. Said circle 73 can be assigned a radius R.

The light beams entering into said cap region of a facet 23 (see FIG. 25) are focused, in the cap region, approximately to a common focal point 61.

In fact, owing to the deviation of the cap shape 72 or the contour of the rotational paraboloid from a sphere, the situation can occur in which there is no exact focal point 61, but rather a focal point range. However, a focal point range of this kind can also be assigned an average focal length fm. This illustration takes into account the fact that an average focal length fm. can be calculated or determined upon considering all the beams passing through the cap region 72 or through the rotational paraboloid of said lens elements 23*e*.

The invention claimed is:

1. A light fixture for illuminating a building surface or part of a building surface, the fixture comprising:

a housing, a light source, collimating optics for collimating light emitted by the light source, a first outer lens plate, a second outer lens plate, a central lens plate between the first outer lens plate and the second outer lens plate, the first outer lens plate being between the collimating optics and the central lens plate, a respective group of lens elements on each of the lens plates, the lens elements of the first and second outer lens plates being lenticular lenses or portions thereof, and an adjustment device for changing a relative spacing between one of the outer lens plates and the central lens plate such that the light fixture provides different light distributions in different relative spacings of the first, second, and third lens plates.

2. The light fixture according to claim 1, wherein the adjustment device is a motorized drive for adjusting the spacing.

3. The light fixture according to claim 1, wherein the adjustment device is a manually operable actuator for changing the spacing.

4. The light fixture according to claim 1, wherein the adjustment device has a positioning device for maintaining a relative rotational position between at least two of the first, second, and central lens plates.

5. The light fixture according to claim 1, wherein the different light distributions comprise a first oval light distribution that extends in a first axial direction and a second oval light distribution that extends in a second axial direction perpendicular to the first axial direction.

6. The light fixture according to claim 1, wherein the light fixture provides different oval light distributions in different relative spacings of the lens plates.

7. The light fixture according to claim 1, wherein the adjustment device varies the spacing continuously.

8. The light fixture according to claim 1, wherein one of the first, second, and central lens plates is fixed relative to the housing, and the other two of the first, second, and central lens plates are displaceable relative to the housing or relative to the central lens plate by the adjustment device.

9. The light fixture according to claim 1, wherein the lens elements on the central lens plates have facets.

10. The light fixture according to claim 9, wherein a plurality or all of the facets each have a curvature that is spherical or approximates a sphere, or is formed as a rotational paraboloid.

11. The light fixture according to claim 1, wherein each lenticular lens or portion thereof of the first outer lens plate is oriented with respect to a respective lens element of the central lens plate.

12. The light fixture according to claim 11, wherein an orientation of each lenticular lens or portion thereof of the first outer lens plate relative to a respective lens element of the central lens plate is such that light components emerging from the collimating optics strike one of the lenticular lenses or portion thereof of the first outer lens plate and are directed therefrom only toward respective lens elements of the central lens plate, and light components emitted by lens elements of the central lens plate are directed therefrom only toward respective lens elements of the second outer lens plate.

13. The light fixture according to claim 11, wherein an orientation of each lens element of the first outer lens plate relative to a respective lens element of the central lens plate is maintained when the spacing between the lens plates is changed.

14. The light fixture according to claim 1, further comprising:

a positive control means for changing the relative spacing between the second outer lens plate and the central lens plate simultaneously with changing of the relative spacing between the first outer lens plate and the central lens plate.

15. The light fixture according to claim 1, wherein the lenticular lenses on the first outer lens plate extend in a first direction and the lenticular lenses on the second outer lens plate extend in a second direction perpendicular to the first direction.

16. A method for changing light emission characteristics of a light fixture for illuminating a building surface or part of a building surface according to claim 1, the method comprising the steps of:

a) providing a light fixture comprising a housing, a light source, collimating optics, and at least three lens plates that are provided in the light path downstream of the collimating optics and each comprising a plurality of lens elements, b) providing adjustment device for adjusting the relative position of one or both of the two outer lens plates with respect to the central lens plate, c) changing the emission characteristics of the light fixture by displacing outer lens plate relative to the central lens plate.

17. A light fixture for illuminating a building surface or part of a building surface, the fixture comprising:

a housing, a light source, collimating optics for collimating light emitted by the light source, a first outer lens plate, a second outer lens plate, a central lens plate between the first outer lens plate and the second outer lens plate, the first outer lens plate being between the collimating optics and the central lens plate, a respective group of lens elements on each of the lens plates, a first adjustment device for changing a relative spacing between the first outer lens plate and the central lens plate, and a second adjustment device for independently changing a relative spacing between the second outer lens plate and the central lens plate independently of the relative spacing between the first outer lens plate and the central lens plate.

18. A light fixture for illuminating a building surface or part of a building surface, the light fixture comprising:

a housing, a light source, collimating optics for collimating the light emitted by the light source, a plurality of lens elements on the collimating optics, two lens plates in the light path behind the lens elements, a plurality of spaced lens elements on each of the lens plates, a first adjustment device for changing a spacing between one of the lens plates and the collimating optics, and a second adjustment device for changing a spacing between the two lens plates such that the light fixture provides different light distributions in different spacing positions of the lens plates from the collimating optics.

* * * * *